US006179982B1

(12) United States Patent
Ting et al.

(10) Patent No.: US 6,179,982 B1
(45) **Date of Patent: *Jan. 30, 2001**

(54) INTRODUCING AND RECLAIMING LIQUID IN A WAFER PROCESSING CHAMBER

(75) Inventors: Chiu H. Ting, Saratoga; William H. Holtkamp, Santa Clara; Richard W. Brodowski, Fremont; Joseph B. Wytman, Los Gatos, all of CA (US)

(73) Assignee: Cutek Research, Inc., San Jose, CA (US)

( * ) Notice: Under 35 U.S.C. 154(b), the term of this patent shall be extended for 0 days.

This patent is subject to a terminal disclaimer.

(21) Appl. No.: 09/183,611

(22) Filed: Oct. 30, 1998

Related U.S. Application Data

(63) Continuation-in-part of application No. 08/916,564, filed on Aug. 22, 1997, now Pat. No. 6,017,437.

(51) Int. Cl.[7] ..... C25D 5/00; C25D 17/00; C25F 3/30; C25F 7/00

(52) U.S. Cl. ..... 205/80; 205/640; 205/157; 204/224 R; 204/224 M; 204/225; 204/269; 204/275

(58) Field of Search ..... 205/80, 640, 687, 205/157; 204/224 M, 224 R, 222, 225, 267, 269, 275

(56) References Cited

U.S. PATENT DOCUMENTS

| | | | |
|---|---|---|---|
| 5,000,827 | | 3/1991 | Schuster et al. . |
| 5,024,746 | | 6/1991 | Stierman et al. . |
| 5,256,274 | | 10/1993 | Poris . |
| 5,368,711 | | 11/1994 | Poris . |
| 5,429,733 | | 7/1995 | Ishida . |
| 5,437,777 | | 8/1995 | Kishi . |
| 5,441,629 | | 8/1995 | Kosaki . |
| 5,447,615 | | 9/1995 | Ishida . |
| 5,516,414 | | 5/1996 | Glafenhein et al. . |
| 5,830,805 | | 11/1998 | Shacham-Diamond et al. . |
| 5,853,559 | | 12/1998 | Tamaki et al. . |
| 6,017,437 | * | 1/2000 | Ting et al. ..... 205/80 |
| 6,042,712 | * | 3/2000 | Mathieu ..... 204/224 R X |

FOREIGN PATENT DOCUMENTS 2628886 7/1997 (JP) .

OTHER PUBLICATIONS

Contolini, R., et al., A Cooper Via Plug Process by Electrochemical Planarization, 1993 VMIC Conference–102/93/0470, Jun. 8–9, 1993, pp. 470–477.

Pai, Pei–Lin & Ting, Chiu, Copper as the Future Interconnection Material, 1989 VMIC Conference, TH–0259–2/89/0000–0258, Jun. 12–13, 1989, pp. 258–264.

Contolini, R., et al., Cooper Electroplating Process for Sub–Half–Micron ULSI Structures, 1995 VMIC Conference—104/95/0322, Jun. 27–29, 1995, pp. 322–328.

(List continued on next page.)

*Primary Examiner*—Donald R. Valentine
(74) *Attorney, Agent, or Firm*—Blakely Sokoloff Taylor & Zafman LLP

(57) ABSTRACT

A processing chamber for depositing and/or removing material onto/from a semiconductor wafer when the wafer is subjected to an electrolyte and in an electric field, and in which the electrolyte is introduced and/or evacuated from a closely confined containment region. A hollow sleeve is utilized to form a containment chamber for holding the electrolyte. A wafer residing on a support is moved vertically upward to engage the sleeve to form an enclosing floor for the containment chamber. One electrode is disposed within the containment chamber while the opposite electrode is comprised of several electrodes distributed around the circumference of the wafer. The electrodes are also protected from the electrolyte when the support is raised and engaged to the sleeve. In one embodiment, the support and the sleeve are stationary during processing, while in another embodiment, both are rotated or oscillated during processing.

19 Claims, 14 Drawing Sheets

OTHER PUBLICATIONS

Ting, Chiu H., et al., Recent Advances in Cu Metallization, 1996 VMIC Conference, 106/96/0481(c), Jun. 18–20, 1996, pp. 481–486.

Contolini, Robert J., et al., Electrochemical Planarization for Multilevel Metallization, J. Electrochem. Soc., vol. 141, No. 9, Sep. 1994, pp. 2503–2510.

Equinox—Single Substrate Processing System, A Semitool Brochure, EQU025–Apr. 1994, pp. 1.8–8.8.

* cited by examiner

INTRODUCING AND RECLAIMING LIQUID IN A WAFER PROCESSING CHAMBER

This is a continuation-in-part application of a patent application titled "Process Chamber And Method For Depositing And/Or Removing Material On A Substrate;" Ser. No. 08/916,564; filed Aug. 22, 1997, now U.S. Pat. No. 6,017,437 which is incorporated by reference herein.

BACKGROUND OF THE INVENTION

1. Field of the Invention

The present invention relates to the field of semiconductor wafer processing and, more particularly, to a chamber and the utilization of the chamber for depositing and/or removing a material on a semiconductor wafer.

2. Related Application

This application is related to an application titled "Rotating Anode For A Wafer Processing Chamber;" Ser. No. 09/183,754, filed Oct. 30, 1998 now U.S. Pat. No. 6,077,412.

3. Background of the Related Art

In the manufacture of devices on a semiconductor wafer, it is now the practice to fabricate multiple levels of conductive (typically metal) layers above a substrate. The multiple metallization layers are employed in order to accommodate higher densities as device dimensions shrink well below one micron design rules. Likewise, the size of interconnect structures will also need to shrink, in order to accommodate the smaller dimensions. Thus, as integrated circuit technology advances into the sub- 0.25 micron range, more advanced metallization techniques are needed to provide improvements over existing methods of practice. Part of this need stems from the use of new materials.

For example, one common metal used for metallization on a wafer is aluminum. Aluminum is used because it is relatively inexpensive compared to other conductive materials, it has low resistivity and is also relatively easy to etch. However, as the size of the various geometry is scaled down to a low sub-micron level, the inherent high current density and electromigration properties associated with aluminum start to manifest as significant problems. Some improvement has been achieved by the use of other metals (such as the use of tungsten for via plugs) in conjunction with aluminum, but the inherent properties of aluminum still limits its effective use.

One approach has been to utilize copper as the material for some or all of the metallization of a semiconductor wafer (see for example, "Copper As The Future Interconnection Material;" Pei-Lin Pai et al.; Jun. 12–13, 1989 VMIC Conference; pp. 258–264). Since copper has better electromigration property and lower resistivity than aluminum, it is a more preferred material for providing metallization on a wafer than aluminum. In addition, copper has improved electrical properties over tungsten, making copper a desirable metal for use as plugs (inter-level interconnect) as well. However, one serious disadvantage of using copper metallization is that it is difficult to depositletch. It is also more costly to implement than aluminum. Thus, although enhanced wafer processing techniques are achieved by copper, the potential cost associated with copper processing is a negative factor. Accordingly, it is desirable to implement copper technology, but without the associated increase in the cost of the equipment for copper processing.

In order to fabricate features, circuits and devices on a substrate, such as a semiconductor wafer, various techniques are known to deposit and etch materials on the wafer. Deposition techniques include processes such as, PVD, CVD, sputtering and immersion of the wafer in an electrolyte. This last technique can be used for either electroless deposition or for electroplating. In an electroplating technique, the substrate is immersed in an electrolyte and positioned in an electric field between a cathode and an anode, in which charged particles are deposited onto the surface of the wafer (see for example, U.S. Pat. No. 5,441,629, which is titled "Apparatus And Method Of Electroplating").

Similarly, a number of techniques are known for removing a material from a wafer. These techniques include, RIE, plasma etching, chemical-mechanical polishing and immersion in an electrolyte. Material removal by subjecting an immersed wafer to an electric field employs an equivalent set-up as for electroplating, but with an opposite result, since charged particles are removed from the wafer in this instance.

The present invention employs electroplating/electropolishing techniques in which a material is deposited/removed from a substrate. The techniques are implemented in a novel processing tool, which is adapted and described in reference to the use of copper for metallization. Accordingly, the practice of the invention provides for material deposition by electroplating and/or material removal by electropolishing, wherein the described techniques can be economically implemented for the mass production of semiconductor products. Furthermore, these techniques can be effectively utilized for copper metallization on a silicon wafer.

SUMMARY OF THE INVENTION

The present invention describes a processing chamber for depositing and/or removing material onto/from a semiconductor wafer when the wafer is subjected to an electrolyte and in an electric field. A hollow sleeve is utilized to form a containment chamber for holding the electrolyte. The sleeve is open at its lower end for mating with the wafer. The wafer resides on a support which moves vertically to engage or disengage the sleeve. Once the wafer is placed on the support, it is raised to engage the sleeve. The support and the wafer mates with the lower opening of the sleeve to form an enclosing floor for the containment chamber (or region).

A first electrode is disposed within the containment chamber, suspended from a shaft extending through the upper end of the sleeve. This first electrode functions as an anode for electroplating and as a cathode for electropolishing. The opposite electrode (cathode for electroplating and anode for electropolishing) is disposed to make contact on the face (or processing) side of the wafer. This electrode is actually comprised of several electrodes distributed around the circumference of the wafer. The electrodes are also protected from the electrolyte when the support is raised and engages the sleeve.

In one embodiment, the support and the sleeve are designed to be stationary during processing. The first (or anode) electrode is designed so that it can be rotated or oscillated to agitate the processing fluid in the containment chamber. The processing fluid (or electrolyte) is introduced through the shaft holding the anode and injected through opening(s) present on the anode.

When the rotating anode configuration is used, the sleeve can be made stationary. The stationary sleeve allows for fluid injection and/or evacuation openings and channels to be disposed along the wall. The evacuation of fluids directly from the containment chamber reduces dilution and loss of the processing fluid(s), so as to improve the recirculation of the fluid or fluids.

DETAILED DESCRIPTION OF THE PREFERRED EMBODIMENTS

A processing chamber for use in depositing a material onto a semiconductor wafer and/or removing material from a wafer by subjecting the wafer to an electric field and electrolyte, and in which the electrolyte is introduced and/or evacuated from a closely confined containment region is described. In the following description, numerous specific details are set forth, such as specific structures, materials, processes, etc., in order to provide a thorough understanding of the present invention. However, it will be appreciated by one skilled in the art that the present invention may be practiced without these specific details. In other instances, well known techniques and structures have not been described in detail in order not to obscure the present invention.

It is to be noted that a preferred embodiment of the present invention is first described in reference to the deposition of a metal material by a technique of electroplating the material onto a semiconductor wafer. The preferred material for the described deposition is copper. However, it is appreciated that the present invention can be readily adapted to the deposition of other metals and alloys (hereinafter, the term metal includes metal alloys) and dielectric materials as well. Furthermore, the present invention need not be limited strictly to semiconductor wafers. The invention can be readily adapted to processing materials on other substrates, including substrates utilized for packaging semiconductor devices such as bump formation or ceramic substrates, and the manufacturing of flat panel displays.

Additionally, alternative embodiments are described in which the chamber of the present invention can be utilized to electropolish materials from similar substrates. For ease of description, etching, polishing, deplating or otherwise removing material as practiced herein are all collectively referred to as electropolishing or polishing, in which an electrolyte and an electric field are utilized for material removal. Different electrolytes would be required and the direction of the current flow in the chamber would be reversed for performing the material removing operation. However, the chamber structure described herein for depositing a material can be readily adapted for removing a particular material from a semiconductor wafer or other substrates.

Figure 1:
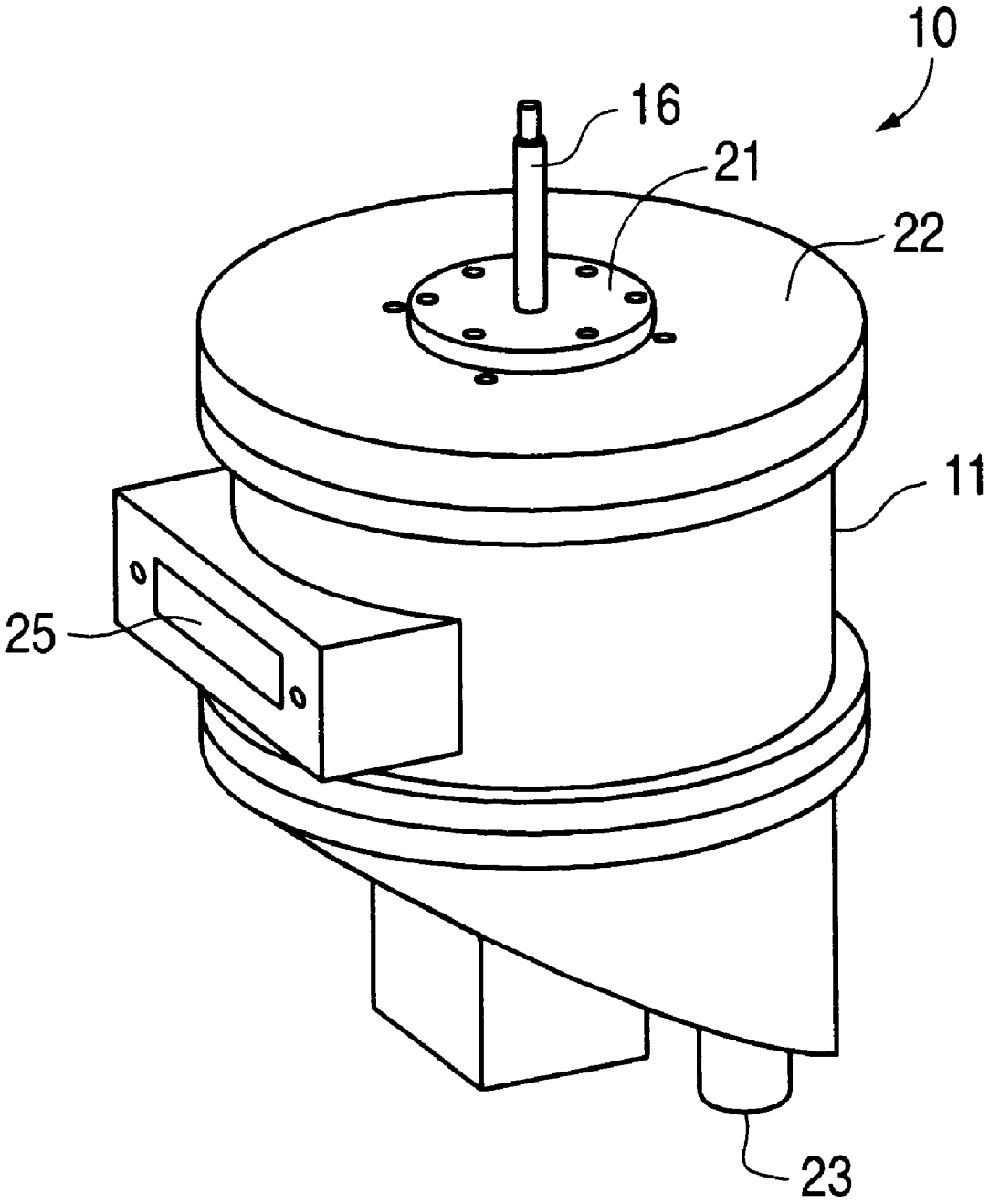
FIG. 1 is a pictorial illustration of a processing chamber of the present invention for processing a material, such as a semiconductor wafer.
Figure 2:
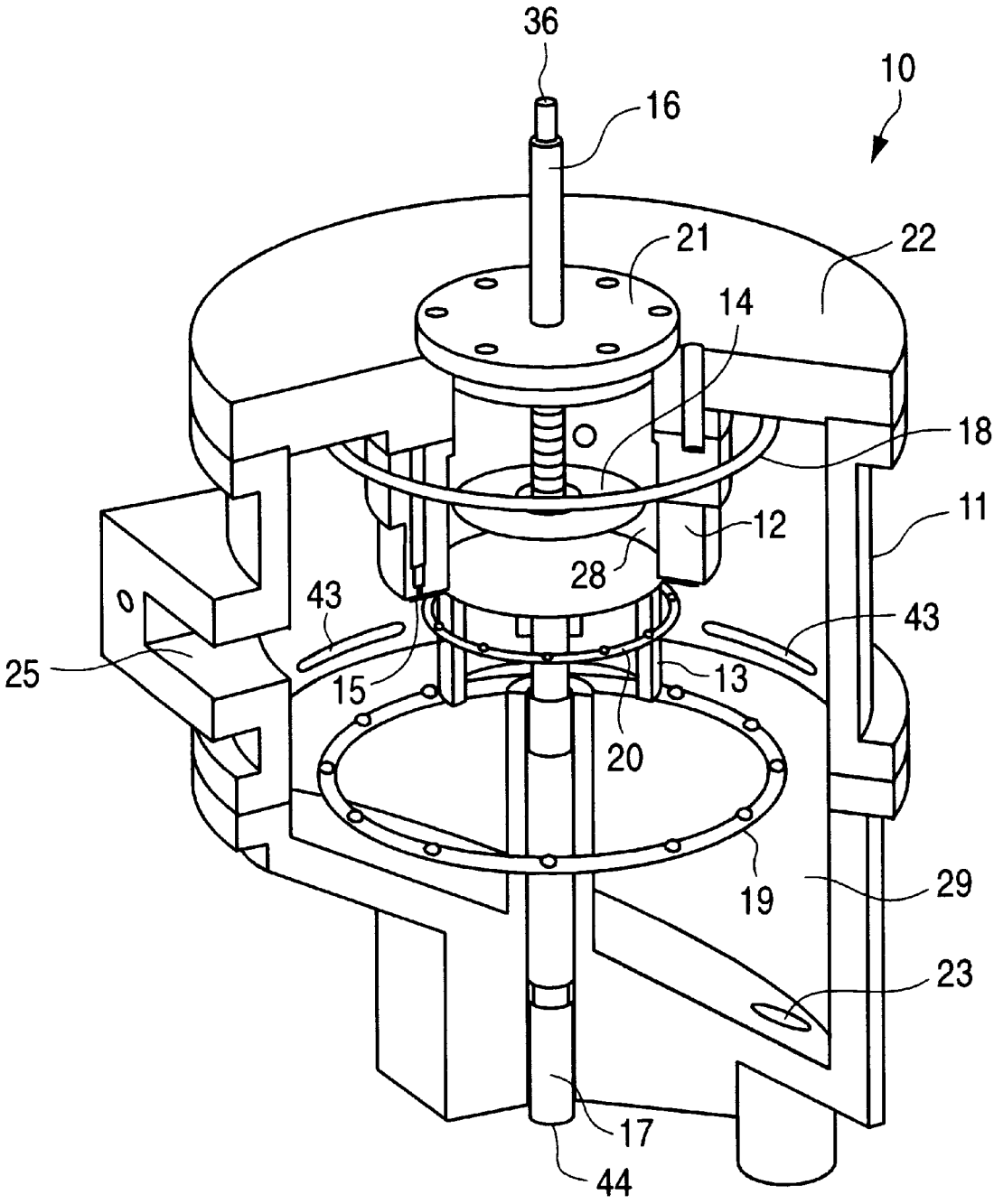
FIG. 2 is a cut-away view of the processing chamber shown in FIG. 1.

Referring to FIGS. 1 and 2, a processing chamber 10 of the preferred embodiment is shown. FIG. 2 is a cut-away view of the chamber 10 shown in FIG. 1. The chamber 10 includes an outer casing 11, inner fluid sleeve 12, wafer support (also referred to as wafer platen or platform) 13, anode electrode 14, cathode electrodes 15, fluid delivery (and anode) shaft 16, wafer rotating shaft 17, two cleansing manifolds 18 and 19, backside purge manifold 20, and covers 21 and 22. It is appreciated that not all of these elements are needed for the practice of the present invention.

Figure 3:
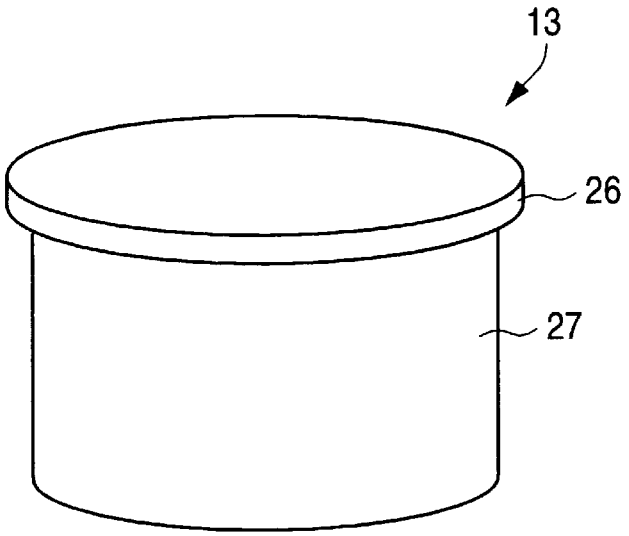
FIG. 3 is a pictorial illustration of a wafer support utilized in the processing chamber of the present invention.

The wafer support (or pedestal) 13, which is shown in more detail in FIG. 3, is a circularly shaped member having a substantially flat upper surface for receiving the wafer thereon. The wafer is placed on the surface of the support 13 when it is to be processed within the chamber 10. As will be described below, an access port 25 located in the outer casing 11 allows for the insertion or extraction of the wafer from the interior of chamber 10. The wafer support 13 is typically shaped as a flat circular disk to accommodate the flat circular semiconductor wafer, such as a silicon wafer. In the preferred embodiment, the wafer support 13 has a flat upper section 26 and a lower extended section 27, so that the support 13 appears more as a cylinder. The upper section 26 receives the wafer thereon and the lower section 27 is utilized as a covering to protect the exposed portion of the wafer rotating shaft 17. As noted, the lower section 27 is hollow in the center to accommodate the shaft 17 and to reduce the mass of the support, if and when it is to be rotated. The bottom of the casing 11 is slanted toward a drain, which removes the spent fluid from the chamber 10. Furthermore, a vacuum line 44 (shown in more detail in FIGS. 5 & 6), disposed within the shaft 17, is coupled to the support 13. At the surface of the of the upper section 26 of the support 13, a number of small vacuum openings are present. The vacuum is applied to the surface of the support 13 when the wafer is disposed thereon to hold the wafer in place.

Figure 4:
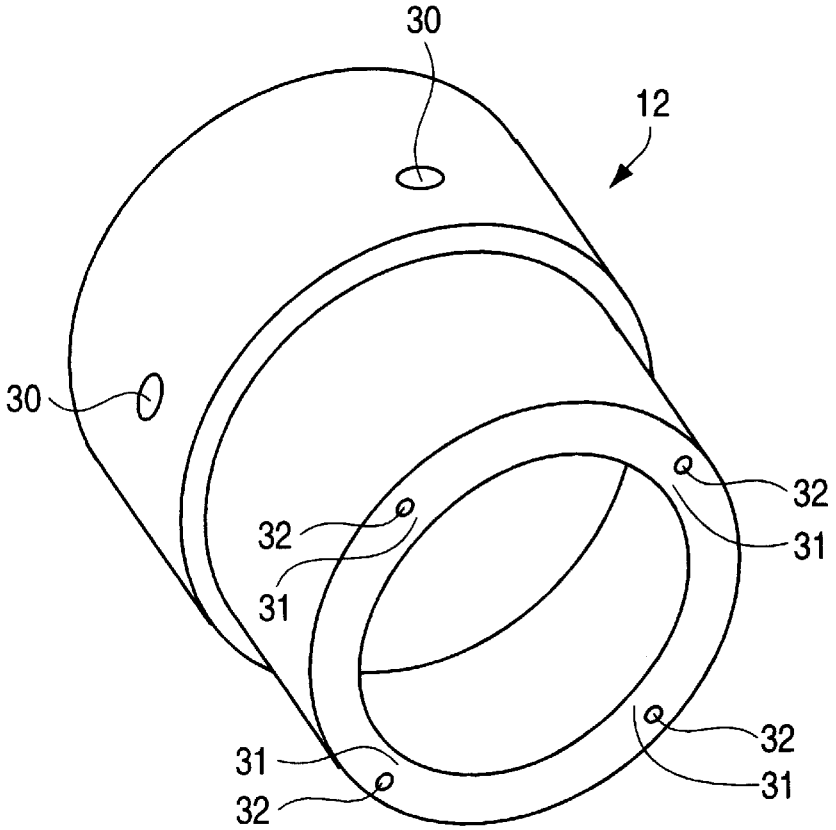
FIG. 4 is a pictorial illustration of a fluid sleeve utilized to contain a processing electrolyte in the processing chamber of the present invention.

The inner fluid sleeve 12 (also referred to as a fluid containment vessel or inner processing chamber) is shown in more detail in FIG. 4 and is shaped as a hollow cylinder that is open at both ends. The sleeve 12 is utilized to hold (contain) the processing fluid (also referred to as electrolyte, processing medium or chemical) when the wafer is to be processed. The lower end of the sleeve 12 mates to a wafer 35 residing on the support 13. The upper opening of the sleeve 12 mates to the casing cover 22. At least one opening 30 is disposed along the cylindrical sidewall of the sleeve 12. The size and the actual number of such opening(s) are a design choice and in the particular embodiment of FIG. 4, four such openings 30 are shown spaced equidistantly apart. The openings 30 function as fluid discharge (or overflow) openings for the fluid in the sleeve 12. Thus, the height of such openings 30 along the sleeve 12 will be determined by the desired height of the fluid which will fill the sleeve 12.

Again, the shape and size of the sleeve 12 is a design choice depending on the shape of the substrate to be processed, but generally the shape is cylindrical to provide a containment wall to conform to the shape of a circular wafer. When in position, the wafer 35 resides at the bottom to form the floor for the sleeve 12, so that the face of the wafer is exposed to the electrolyte residing within the sleeve 12. It is to be noted that only the outer edge portion of the wafer (which is usually left unprocessed) mates with the sleeve 12. The sleeve 12 of the preferred embodiment includes four contact locations 31, which are associated with the placement of the cathode electrodes 15. Correspondingly disposed at the contact locations 31 and within the wall of the sleeve 12 are hollow openings (or channels) 32. The channels 32 are utilized to couple electrical connections to the cathodes 15 located at the bottom of the sleeve 12. These channels 32 allow the placement of electrical connections to the wafer surface, but shield the electrical connections from the corrosive effects of the electrolyte.

Figure 5:
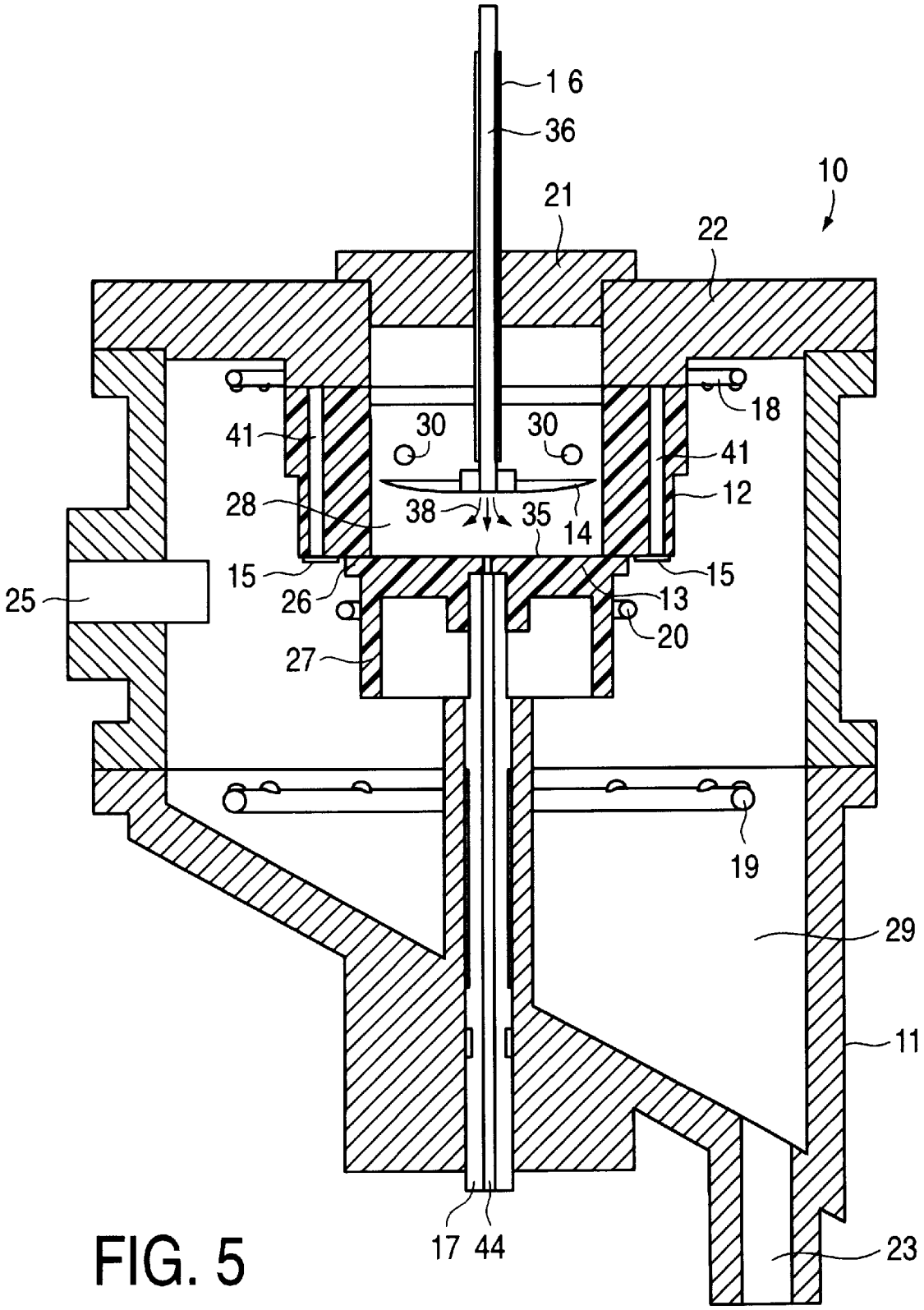
FIG. 5 is a cross-sectional view of the processing chamber of FIGS. 1 and 2 showing the position of the wafer support when it is raised to engage the sleeve.

FIG. 2 shows the interior of the chamber 10 when it is assembled and FIG. 5 shows the corresponding cross-sectional view. The wafer support 13 is shown in the up (or engaged) position. In the engaged position, the wafer support 13, having the wafer residing thereon, is made to engage the sleeve 12. Although a variety of techniques are available to engage the two components 12 and 13, in the preferred embodiment, the wafer support 13 is made movable in the vertical direction. The down (or disengaged) position of the wafer support 13 is shown in FIG. 6.

Figure 6:
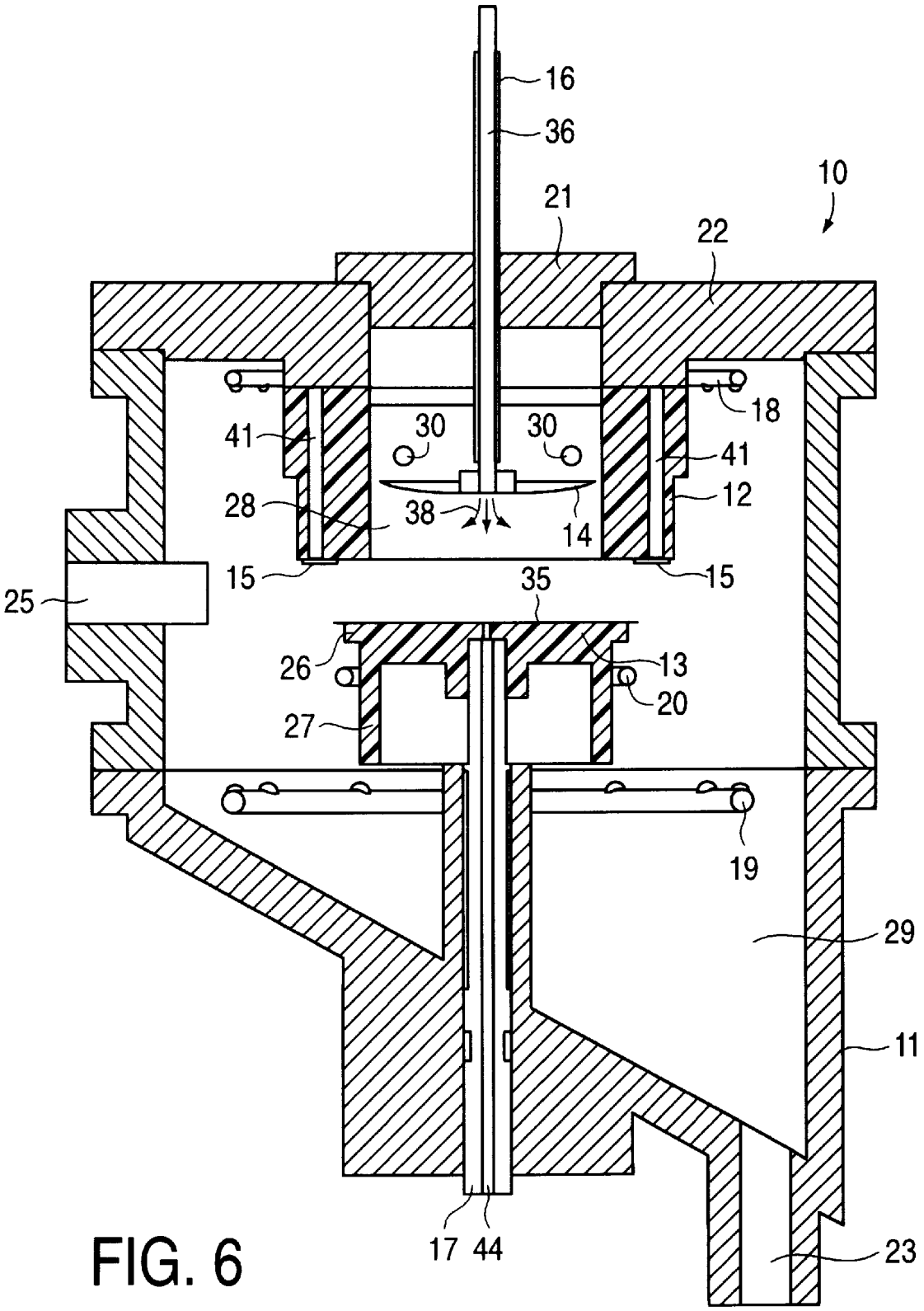
FIG. 6 is a cross-sectional view of the processing chamber of FIGS. 1 and 2 showing the disengaged position of the wafer support from the sleeve.

As illustrated in FIGS. 2, 5 and 6, the upper end of the sleeve 12 is coupled to the casing cover 22. The manner in which the sleeve is coupled to cover 22 is described later and will also depend on if the sleeve 12 is made to rotate within the chamber 10. The cover 22 is affixed onto the casing 11 to mount the sleeve 12 within the chamber 10, as well as providing a top enclosure for the chamber 10. As shown, the cover 22 has a central opening, which placement corresponds with the upper open end of the sleeve 12. The anode electrode 14 and its accompanying shaft 16 is inserted into position through the opening in the cover 22 to place the anode 14 to reside within the interior of the sleeve 12. The interior of the sleeve 12 forms a primary containment region 28 for the holding of the electrolyte, when the wafer is positioned to function as the floor of the containment region 28. The shaft 16 passes through a shaft opening in the anode cover 21 and the cover 21 is mounted onto the casing cover 22. Mounting means, such as bolts or screws, are used to mount the covers 21 and 22. Once the covers 21 and 22 are mounted in place, the chamber 10 is completely enclosed for processing the wafer.

As shown in the drawings, the wafer support 13 is mounted onto one end of the shaft 17. The other end of the shaft 17 extends through the casing 11. The shaft 17 provides for mechanical motion and a conduit residing therein couples vacuum to the surface of the support 13. As described later, the shaft 17 can be coupled to a rotary driving means, such as a motor, which provides the rotational movement for turning the support 13. Bushings, gaskets, bearings and/or other seals are used to maintain integrity in order to prevent escape of liquids and/or fumes.

It is generally an accepted practice to rotate a wafer when it is subjected to certain processing medium. The rotation ensures a more uniform distribution of the medium over the wafer surface. Accordingly, the practice of rotating the wafer 35 on the wafer support 13 will also depend on the medium utilized in the chamber 11 and the effectiveness of its distribution for the process being performed. Thus, one approach is not to rotate the wafer. However, where rotation of the wafer aids in the medium distribution, the wafer support 13 can be rotated by rotating the shaft 17. Although the speed of rotation is a design choice for the particular process being practiced, a typical range is 5–500 rpm (revolutions per minute). Furthermore, instead of rotating the wafer at a particular rpm, the wafer can be oscillated (or agitated) back and forth. It is appreciated that the present invention can be practiced by rotating (or oscillating) the wafer or the wafer support can remain stationary.

In the practice of the invention, the shaft 17 is also made movable in the vertical direction, in order to vertically move the support 13. As shown in the down position in FIG. 6, the support 13 is positioned to receive or remove a wafer through the access port 25. This is the transfer entry (receiving) position for the wafer support 13. The wafer is aligned with the access port 25, which provides the interface between the interior of the chamber 11 and the environment external to it. Utilizing one of a variety of wafer handling tools, the wafer 35 is loaded into the chamber 11 through the access port 25 to be positioned over the support 13. The shaft 17 with the support 13 raises to effect the transfer of the wafer to the support 13. The loading mechanism withdraws and subsequently, the shaft 17 rises with the support 13 and the wafer 35 engages the sleeve 12.

The engaged position of the support 13 is shown in FIG. 5 and is noted as the upper (or engaged) position of the wafer support 13. The lower (or cleaning and drying) position of the wafer support, places the wafer below the opening of the access port 25 for cleaning and drying the wafer 35. This lower position ensures that when the wafer is spun, liquids are not spun out of the access opening. When the processing is complete and the wafer is to be removed from the chamber, the support 13 is positioned to a transfer exit position for removing the wafer 35 from the chamber 10. The wafer handler mechanism (not shown), inserted through port 25, will then extract the wafer through the port opening. The transfer entry and exit positions may or may not be the same position, depending on optimum handling method employed when integrated with a wafer handler mechanism.

Anode Electrode

Figure 7:
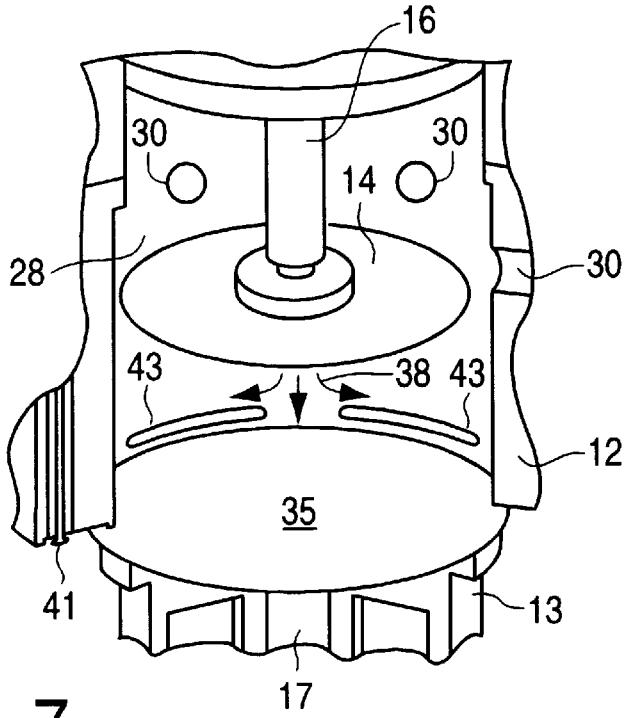
FIG. 7 is a cross-sectional view of the electrolyte containment region formed when the wafer support is engaged to the sleeve and the positioning of an anode within the containment region.

As shown in more detail in FIG. 7, the anode electrode (also referred to simply as the anode) 14 is attached (by means such as a bolt, screw, clamp or solder) to the end of the upper shaft 16 and is made to reside within the containment region 28. The shaft is made to fit through the cover plate 21. The height of the anode 14 above a wafer 35 residing on the wafer support 13 is dependent on the electrical parameters and the process being performed. Typically, for electroplating/electropolishing processes, it is desirable to immerse the anode within the electrolyte. Accordingly, it is desirable to position the anode 14 below the flow openings 30 so that the anode is immersed in the electrolyte.

Generally, the height of the anode is fixed so that once positioned, the anode 14 is positioned at a set location within the containment region 28. The actual position of the anode, relative to the wafer, is a design choice dictated by the particular system and the process being performed. The anode-wafer separation distance is a parameter in determining the electric field intensity between the anode 14 and the wafer 35.

The shaft 16, not only positions the anode 14 in place, but also provides a conduit for introducing a electrolyte into the containment region 28 of the sleeve 12, as shown by flow arrows 38. A central hollow channel (or passage) 36 within the shaft 16 allows one or more fluids to be piped into the containment region 28 of the sleeve 12. The opening at the end of the passage 36 is located proximal to the surface of the anode 14 facing the wafer, so that the fluid is introduced into the bounded containment region 28 below the anode 14. This injection location of the processing fluid into the sleeve 12 ensures a presence of fresh processing fluid proximal to the wafer surface.

It is appreciated that a piping for transporting the liquid can be readily coupled or inserted into the passage 36. It is also appreciated that a number of fluid medium (both liquids and gases), can be introduced into the containment region 28 through the passage 36. Accordingly, in the preferred embodiment, multiple fluids are introduced through passage 36. For example, for electroplating metal onto the wafer 35, the electroplating fluid (which is typically a liquid) is first pumped into the containment region 28. Once the electroplating process is completed and the electrolyte drained, de-ionized (DI) water is pumped and injected onto the surface of the wafer to wash it. Subsequently, nitrogen ($N_2$) gas is pumped into the containment region 28 to dry the wafer prior to its removal from the chamber 10. It is appreciated that the wafer 35 can be cleaned and dried a number of times, including prior to the introduction of the electrolyte. Typically, the cleaning and drying cycles are performed with the wafer support 13 positioned at the lower position.

Figure 8:
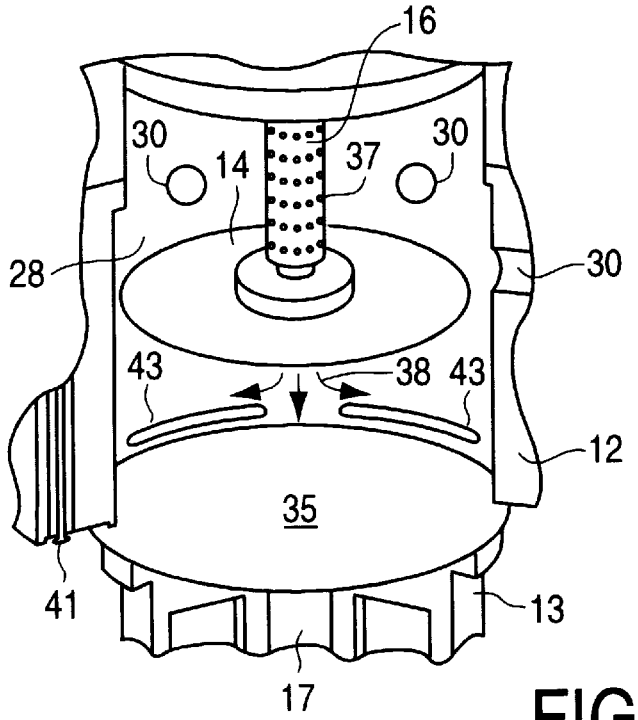
FIG. 8 is a cross-sectional view of an alternative embodiment having an anode shaft with openings for distribution of fluids.

Referring to FIG. 8, an alternative anode shaft design is shown. In this embodiment, a plurality of openings 37 are disposed along the side of the shaft 16. The central passage 36 is still present to deliver the various fluids at the central anode opening as described above. However, a secondary passage is formed between the central passage 36 and the wall of the shaft 16, so that a secondary channel or passage in the form of a hollow sleeve is concentrically formed around the central passage 36.

As shown in FIG. 8, the plurality of openings 37 are disposed along the outer wall of the shaft 16. The openings 37 extend through to the secondary passage so that the fluid being pumped in the secondary passage is passed through the openings 37. Again, a variety of fluids can be pumped through openings 37, similar to that for the central passage 36. However, in the practice of the present invention, only the fluids associated with the cleaning and drying are pumped through openings 37.

Accordingly, when the wafer is placed into the upper position, the electrolyte is pumped only through the central passage 36 to expel onto the region between the anode 14 and the wafer 35. However, during the DI water cleansing step and the subsequent $N_2$ drying step (when the wafer 35 is at the lower position), both passages accommodate the DI water and the $N_2$. Thus, not only is the wafer surface cleaned and dried, but the inner wall of the sleeve 12 is also cleaned and dried as well, to remove any residual electrolyte left in the containment region 28. The openings 37 ensure that DI water and $N_2$ are injected at upper regions of the sleeve 12 to remove residue from the components and surfaces residing within the sleeve 12.

Figure 14:
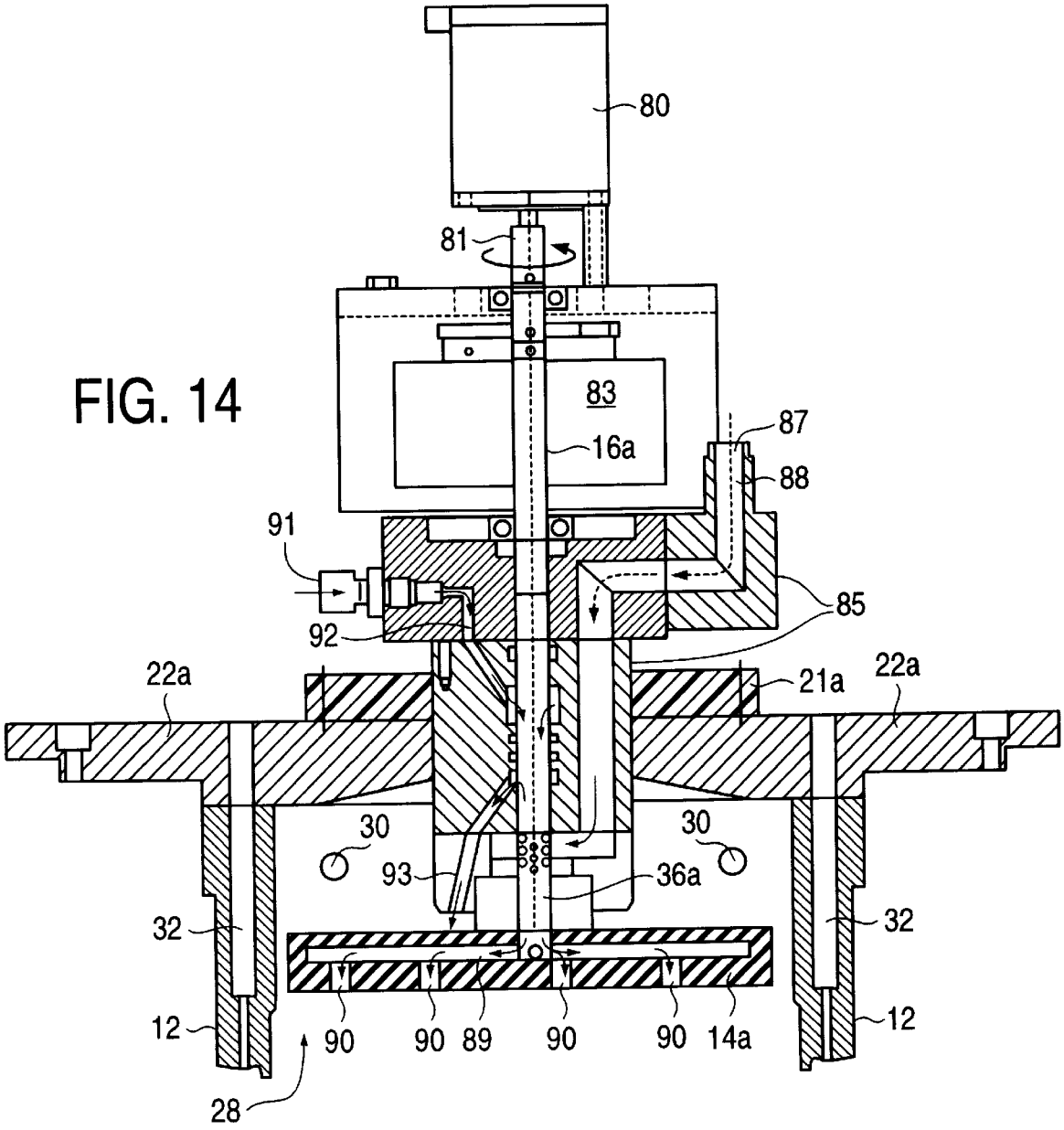
FIG. 14 is a cross-sectional view of an alternative anode design in which the anode is made to rotate.

Another alternative anode configuration is shown in FIG. 14. The particular embodiment shown utilizes a rotating anode 14*a* for the anode 14 described above. The rotating anode 14*a* is made to rotate or oscillate within the containment region 28 to agitate and distribute the electrolyte. In some applications, it may be desirable to not rotate the wafer and/or the sleeve 12, since the rotation of the sleeve 12 requires specialized design considerations for the interfacing of various moving components. If the electrolyte is to be sealed within the containment region 28, the wafer 35 will need to maintain sufficient fluid seal with the sleeve 12. Since fluid sealing integrity may be difficult to maintain at the wafer-sleeve interface, in most instances, it is desirable for the wafer and the sleeve to be fixed relative to each other. That is, for tight seal integrity at the wafer-sleeve interface, it is desirable for both components to be rotated in unison or not at all.

Instead of rotating both the wafer and the sleeve 12 at the same angular speed, a more desirable approach is to rotate the anode within the containment region 28. The rotating anode 14*a* allows for both the wafer and the sleeve to remain stationary, but provides for fluid agitation or distribution. Accordingly, the rotating or oscillating action of the anode 14*a* within the sleeve 12, has an equivalent effect as if the sleeve and the wafer were both rotated.

In order to rotate the anode 14*a*, a motor 80 is coupled to an anode shaft 16*a* at its top end through couplings 81. A slip ring assembly 83 (similar to the later described slip ring assembly used with the rotating sleeve) is utilized to provide the electrical coupling to the rotating anode 16*a*. Since the anode 14*a* is mounted at the lower end of the shaft 16*a*, the rotation of the shaft 16*a* causes the anode 14*a* to rotate. A transfer housing assembly 85 is utilized for supporting and positioning the shaft 16*a*, as well as for allowing for the distribution of various fluids into the containment region 28. Although the actual layout is a design choice, the particular embodiment of FIG. 14 shows an inlet 87 on the housing 85 for the introduction of various fluids (such as, electrolytes, d.i. water, air or gas). A channel 88 within the housing 85 directs the fluid(s) from the inlet 87 to a lower section of the shaft 16*a*, which is hollow and has openings for passage of the fluid.

The lower end of the shaft 16*a* is coupled to the anode 14*a*. The processing fluid is fed to the shaft 16*a* by the channel 88. The fluid passes through the hollow region of the shaft 16*a* and is fed to the anode 14*a*. The fluid can be injected into the containment region through a central opening in the anode as described above with the stationary anode 14 or it can be distributed across the surface of the anode. In the particular example shown, the anode 14*a* has channels 89 throughout, so that fluid can be injected from a plurality of openings 90 located along its lower surface (facing the wafer). Accordingly, the anode 14*a* shown in FIG. 14 has sufficient thickness in order to accommodate the fluid distribution channels 89. The flow path of the fluid from inlet 87 to the containment region 28 is shown by the flow arrows in FIG. 14.

Another inlet opening 91 is shown for the coupling of a purge gas to the shaft 16*a*. Typically, air or a neutral gas (such as nitrogen) is coupled to the inlet 91. The purge gas is routed to the shaft 16*a* by a channel 92. The purge inlet to the shaft is maintained higher on the shaft 16*a* than the processing fluid entrance, so that the injection of the purge gas will force the air or gas downward to purge and cleanse the interior of the shaft and the anode. It is appreciated that the air or neutral gas can also be injected at the inlet 87 to purge the fluid feed channel 88.

Although not critical for operation, a fluid bypass channel 93 is incorporated in the example of FIG. 14. The bypass 93 is located on the shaft 16*a* above the processing fluid entrance, but below the purge gas entrance. The bypass 93 is utilized as a pressure release and to ensure that the level of the processing fluid does not rise above this level during processing of a wafer. The bypass 93 functions as an overflow release for the fluid. If the fluid level does reach this point on the shaft 16*a*, the bypass 93 routes the excess fluid as leakage into the containment region 28. Further, purging pressure through the channel 88 can push processing fluid upwards and conflict with the purging gas flowing downward through the channel 92 The bypass 93 ensures that there is a pressure relief opening to prevent the build up of pressure in the channels 88 and 92. In FIG. 14, the leakage empties onto the top of the anode 14*a*.

The rotating anode configuration allows for various alternatives for the averaging the effects of rotation. FIG. 14 shows only one implementation in which the anode is circular in shape. Other shapes can be employed. Furthermore, extensions (such as vanes) can be attached to further increase the agitation and distribution of the processing fluid in the containment region 28. These extensions can be either conductive or non-conductive. The anode can have a central opening for the injection of the fluid (as shown in FIGS. 5–8) or multiple openings distributed along the surface for a rotating injection of the fluid (as shown in FIG. 14). The rotating anode also improves the rinsing and drying cycles, since high speed rotation allows cleansing fluids to be imparted onto the inner wall of the sleeve 12.

Although the rotation or oscillation speeds will vary depending on the process, typical rotational speed for processing a wafer is in the approximate range of 5 to 100 revolutions per minute (rpm), while rinse and spin dry speeds are in the approximate range of 200–2000 rpm. The anode can be constructed from variety of materials utilized for providing electrodes for the given process being implemented. For copper deposition, the preferred material for the anode is platinum or platinum coated metal. However, it is appreciated that other materials readily used as electrode materials can be adapted for use as well.

Furthermore, the housing assembly 85 and the various fluid distribution channels can be designed an a variety of ways. Since the sleeve is stationary, the fluid inlets can be routed through the sleeve or one of the upper covers (or plates). It should be noted that the design of covers 21*a* and 22*a* to enclose the upper portion of the sleeve 12 have been revised in FIG. 14 for accommodating the housing assembly 85. It is also to be emphasized that the anode 16*a* would function as a cathode when the processing chamber is to be used for electropolishing. Thus, an alternative design for the processing chamber is to maintain a non-rotating sleeve and wafer, but rotate (or oscillate) the anode to obtain the required fluid agitation and distribution.

Cathode Electrodes

Figure 9:
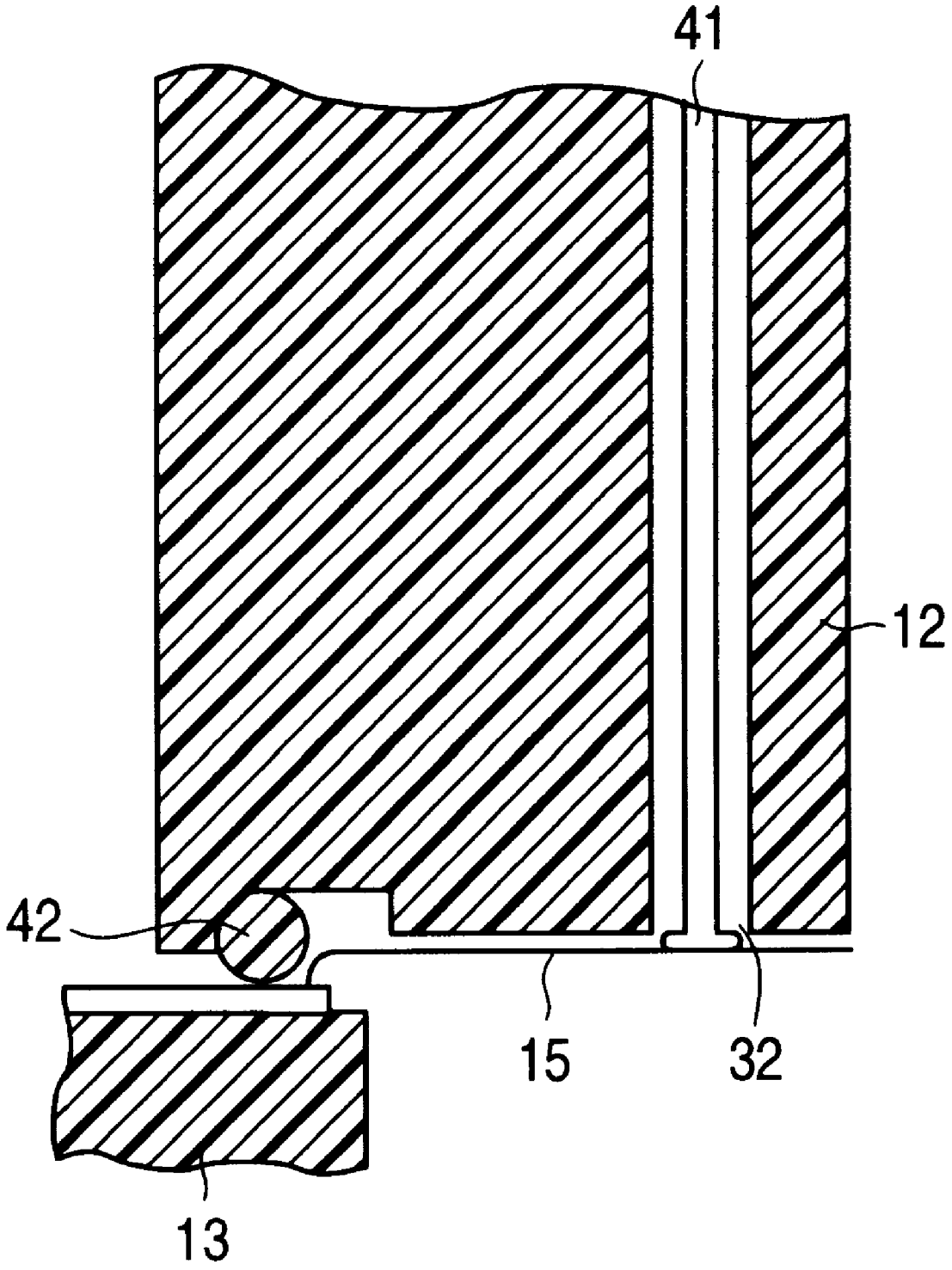
FIG. 9 is a cross-sectional view showing one of several cathode electrodes used in the processing chamber.

Referring to FIG. 9, one of the cathode electrodes (also referred to simply as the electrode) 15 is shown in more detail in FIG. 9. Although the actual number of such electrodes 15 is a design choice, the processing chamber 10 of the present invention utilizes four such electrodes 15 (for a 200 mm size wafer), spaced equidistantly around the bottom end of the sleeve 12. The electrode 15 is an elongated electrical conductor which is bent or spring-loaded downward at one end to make contact with the edge of the wafer 35. Each electrode 15 is affixed to the bottom surface of the sleeve 12 by coupling it to an electrical conductor 41. Thus, when the sleeve 12 is assembled and placed within the chamber 10, each electrode 15 is attached to its corresponding electrical conductor 41 at one end and the other end makes contact with the edge of the wafer 35. All of the electrodes 15 form a distributed cathode which contacts are to the face-side of the wafer that will undergo the electroplating process.

Thus, the electrical coupling to each of the electrodes 15 is provided by the corresponding electrical conductor 41, which is inserted through a corresponding channel 32 within the sleeve 12, wherein the end of the conductor 41 is attached (such as by solder) to its respective electrode 15. The other ends of the conductors exit the chamber through the casing cover 22 or 21 or integrated through the shaft 16. The manner in which the electrical wiring is routed is a design choice.

Also noted in FIG. 9 is a seal 42 disposed between the wafer end of the electrode 15 and the interior wall of the sleeve 12. As noted, the seal 42 is positioned adjacent to the interior wall of the sleeve 12, so that it can effectively inhibit the electrolyte from reaching the electrode 15 when power is to be applied to the electrode. It is to be appreciated that the process of electroplating or electropolishing will not actually occur until power is applied to the anode and cathode electrodes.

However, once power is applied, there is a tendency for surfaces (other than wafer 35) in contact with the solution to undergo the plating or polishing process as well. Accordingly, by using the seal 42 to prevent the electrolyte from reaching the electrode 15, the electrodes will not be plated/polished once power is applied. It is appreciated that by sealing and protecting the cathode electrodes 15 from the plating solution, no deposition will accumulate on (or material removed from) the electrodes 15. This prevents the build up (or removal) of material on/from the electrodes 15, which material can become contaminants within the chamber during processing.

The seal 42 can be fabricated from a variety of materials which are resistant to the processing fluid being utilized. In the preferred embodiment, polypropylene or some other equivalent polymer (for example, VITON™ or TEFLON™ materials) is used. If the sleeve 12 is to mount flush with the wafer 35 along the complete periphery of the wafer 35, then a ring seal can be utilized. However, if flow gap(s) 43 (see FIGS. 2, 7 and 8) is/are located at the bottom of the sleeve—wafer interface, then individual seals, preferable U-shaped, are required at each of the electrode contact locations because of the gap(s). The seal(s) should effectively inhibit the electrolyte from reaching the electrode contacts 15.

One or more flow gap(s) 43 can be located at or near the bottom of the sleeve 12. The actual location is a design choice. In the Figures, the flow gaps 43 are shown located near the bottom of the sleeve 12. The use of flow gaps 43 is an alternative embodiment of the sleeve 12. A purpose of the flow gaps 43 is to allow for a more even flow distribution along the surface of the wafer face. It is to be noted that the openings 30 are still present. The flow gaps 43 allow for fluid movement along the bottom of the containment region 28, from the center at the fluid entry point to the periphery of the wafer 35. The lateral fluid movement near the surface of the wafer 35 ensures a more uniform replenishment of the electrolyte, which in turn improves the thickness uniformity of the deposited material (which is typically a thin film layer).

It is also to be noted that when the process is completed and the wafer disengages from the sleeve 12, some amount of the electrolyte may contact the electrodes. However, the electrodes are not under power at this stage and any amount of fluid contacting the electrodes 15 are washed away during the cleaning phase.

Referring back to FIGS. 5 and 6, several other features of the chamber 10 are shown. The three ring-shaped manifolds 18–20 are utilized to inject DI water and/or nitrogen at the particular location where they are located. The upper manifold 18 is located at the upper vicinity of the chamber 10 for spraying DI water downward to wash away the remaining electrolyte from the walls of the casing 11 and sleeve 12. The lower manifold 19 is located around the lower shaft 17 in the vicinity of the wafer support 13, so that DI water can be sprayed to clean any remaining fluid on or around the wafer support 13, when the wafer support 13 is in the lower position. The cleaning is typically performed with the wafer support 13 in the lower position. The two cleaning manifolds 18 and 19 also inject $N_2$ as well to provide the drying of the interior of the chamber, which forms a secondary containment region 29. The two manifolds 18 and 19 are positioned at their respective locations by support members (not shown) attached to the casing cover 22, so that when the casing cover 22 is removed, the manifolds 18 and 19, along with the sleeve 12 can be removed from the chamber 10 as a single attached unit. The fluid (water and $N_2$) couplings to the manifolds 18 and 19 are also not shown, but are present and such lines will extend out from the casing 11, generally through the top cover 21 or 22 or integrated within shaft 16.

The middle cleansing manifold 20 is a purge manifold. It is disposed around the upper end of the wafer support 13. Its support members (not shown) attach it also to the casing cover 22. This manifold 20 is utilized to inject $N_2$ onto the edge of the wafer during processing when the electrolyte is flowing in the chamber 10. Since there is electrolyte flow during the processing cycle, the injection of $N_2$ along edge of the wafer prevents the electrolyte from reaching the backside of the wafer and the surface of the support 13.

It is appreciated that the chamber 10 is fully functional without one or all of the cleansing manifolds 18–20. However, the manifolds when utilized properly can provide for a cleaner environment within the chamber 10, improve system productivity and extend the maintenance cycle of the components present in the chamber 10.

Rotating Sleeve

In an alternative embodiment, the sleeve 12 is made to rotate (or oscillate) when the wafer 35 is in the engaged position. That is, wafer rotation is desirable when the wafer is undergoing the electroplating/electropolishing process. The rotating sleeve could be utilized in the instance the anode is made stationary. With the rotating anode configuration, the sleeve would not need to be rotated. However, if rotational capability for the sleeve 12 is to be implemented, the upper end of the sleeve 12 cannot be affixed to the stationary casing or cover. Furthermore, some type of rotational coupling is needed in order to couple the rotating conductors 41 to a stationary electrical connection.

Figure 10:
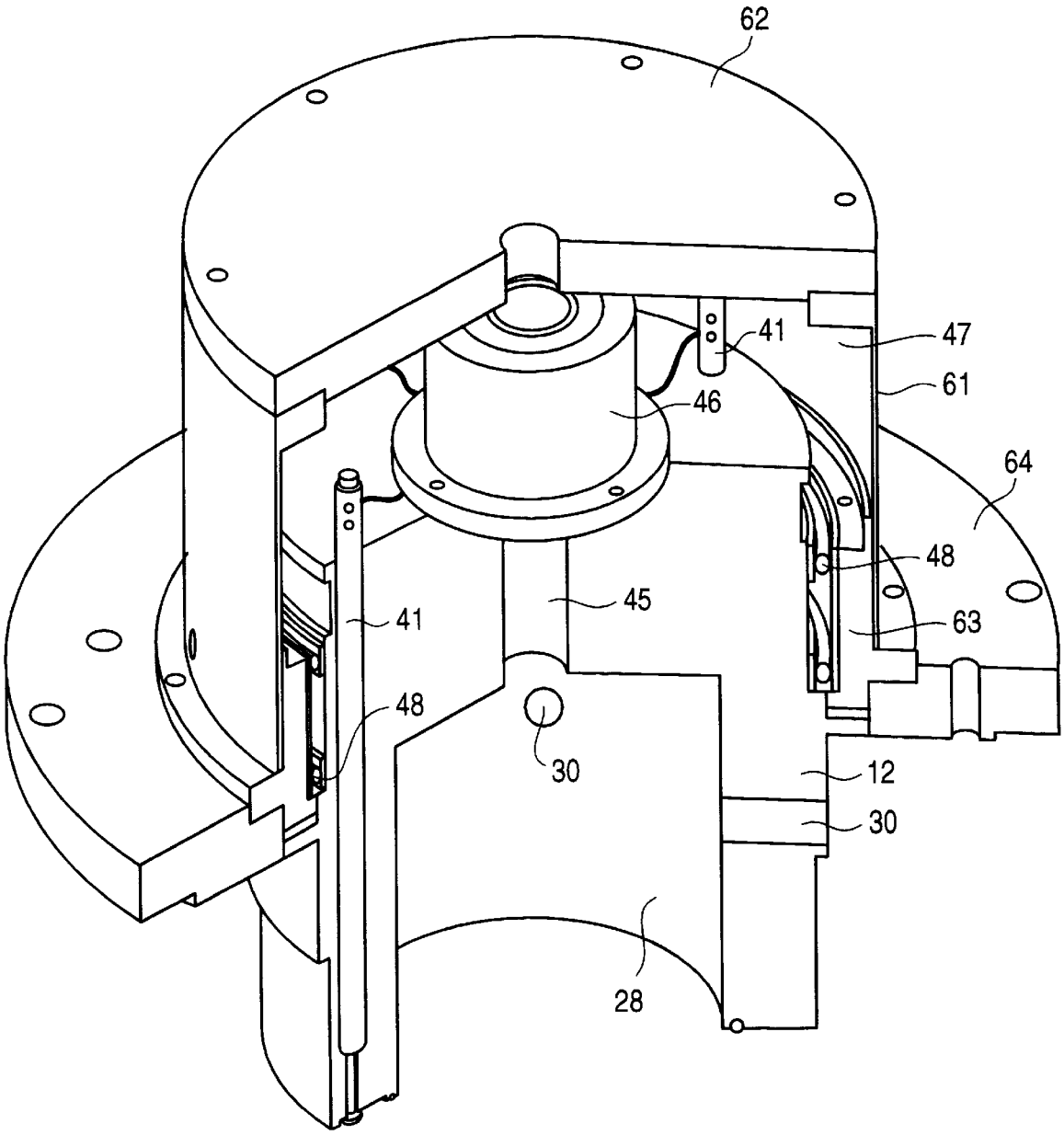
FIG. 10 is cut-away view of an alternative embodiment of the present invention in which a rotating or oscillating sleeve is employed to rotate the wafer during processing.

FIG. 10 illustrates an embodiment in which a rotating electrical coupling is utilized. A variety of rotating electrical couplings can be used at the sleeve/cover interface, but the example of FIG. 10 utilizes a slip ring assembly 46. The vessel 12, is driven to rotate by the rotation of the wafer support 13. In the preferred embodiment, dowel pins located at several points along the periphery on the sleeve 12 mate to corresponding holes located on the flat upper section 26 of the wafer support 13. The rotational movement of the support 13 will then also cause the sleeve 12 to rotate in unison.

With a moving sleeve 12, the electrical conductors 41 will also rotate. The slip ring assembly 46 is mounted on to the top end of the sleeve 12 and is made to rotate with the sleeve 12. A containment housing 61, along with a cover flange 62, form an enclosure for the upper portion of the sleeve 12 and assembly 46. The height of the containment housing 61 is such that a cavity 47 forms between the top of the sleeve 12 and the cover flange 62. The sleeve 12 in this instance has its upper end enclosed, except for a central opening 45, which is needed for the passage of the anode shaft 16. The slip ring assembly 46 fits into this cavity area. The anode shaft 16 passes through the cover flange 62 and assembly 46 through the opening 45, so that the anode resides within containment region 28.

The electrical conductors 41 are coupled to contacts on the slip ring assembly 46 and both rotate in unison. The stationary part of the slip ring assembly 46 is at the center and the shaft 16 is coupled through it. The stationary electrical connections are made at this point. An example of a slip ring assembly is Model AC4598 (or AC4831) manufactured by Litton poly-Scientific of Blacksburg, Va.

In the practice of the present invention employing a rotating sleeve 12 as shown in FIG. 10, inert gas (such as $N_2$) is forced to flow within the cavity 47. The $N_2$ gas is made to flow downward from cavity 47 between the sleeve 12 and the containment housing 61. The positive pressure $N_2$ flow ensures that fumes from the electrolyte do not collect in the open areas along the side and above the sleeve 12. In the particular embodiment shown in FIG. 10, a mechanical coupling, such as a bearing flange 63, is utilized between the sleeve 12 and an upper flange 64 of the containment housing 61 for physical support of the sleeve 12. Bearings 48 are used to provide the mechanical support but allow the sleeve 12 to rotate relative to the flange 64 and containment housing 61. Thus, by utilizing the embodiment shown in FIG. 10, the wafer 35 can be made to rotate (or oscillate) in the engaged positioned when subjected to the electrolyte.

Wafer Processing

The following description describes the practice of the present invention to process a semiconductor, such as a silicon semiconductor wafer. Furthermore, the process described is for electroplating a metal (the term metal herein includes metal alloys) layer onto the wafer 35. The chamber is utilized as a deposition chamber in that instance. The exemplary material being deposited is copper. Subsequently, a process is described in which a metal is removed from the wafer 35, when the chamber is used for electropolishing. However, it is to be appreciated that other processes and materials can be employed for deposition or polishing without departing from the spirit and scope of the present invention.

Figure 11:
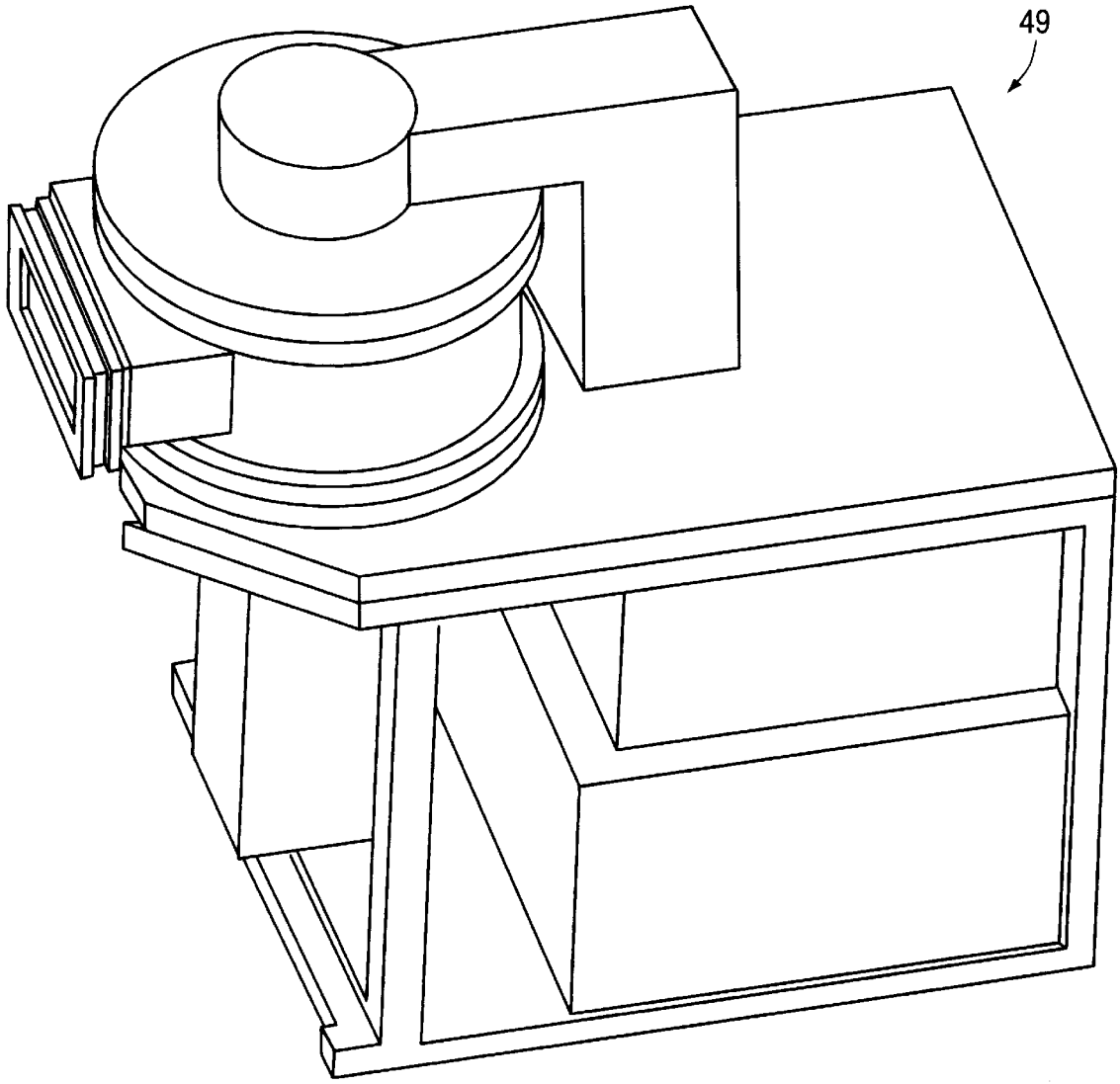
FIG. 11 is a pictorial illustration of one configuration for packaging the processing chamber of the present invention.

Referring to the previous Figures, when copper (Cu) is to be deposited onto a semiconductor wafer by the use of an electroplating technique, the chamber of the present invention can be utilized. Generally, the chamber 10 of the present invention is assembled as part of a functional unit, which one embodiment is shown in FIG. 11. Equipment housing 49 is a modular unit designed to house the processing chamber 10 and its associated mechanical and electrical components, such as electrical wiring, fluid distribution piping, couplings to external system components, mechanisms for rotating (or oscillating), raising/lowering the wafer support 13, raising/lowering the anode 14. The processing chemical, DI water, nitrogen and vacuum connections are made to the unit 49 for distribution to the chamber 10. The drain 23 is coupled to a container for containing the electrolyte or to a waste treatment component of the system. It is appreciated that the delivery and removal of such chemicals and fluids to/from a processing chamber are known in the art. Thus, housing 49 is but one example of how the chamber 10 can be configured.

Once the chamber is assembled and configured for processing the wafer 35, the support 13 is lowered to its load position. The wafer is then introduced into the chamber 10 through the port opening 25. Typically, an automated wafer handler is used to place the wafer 35 in position for the support 13 to rise and accept the wafer. The wafer 35 is held in place by the application of vacuum to the underside of the wafer 35. The port 25 opening is closed to seal the chamber 10. Subsequently, the support 13 is raised to its upper engaged position by the movement of shaft 17, as shown in FIG. 5, to mate with the sleeve 12.

The coupling of the support 13 to the sleeve 12 will depend on the embodiment selected for the sleeve 12. If the sleeve 12 is to remain stationary, then it is affixed to the cover 22 and will not rotate. If the sleeve is to rotate, then the embodiment of FIG. 10 is used. It is to be appreciated that the wafer support 13 can still be made to rotate when disengaging from the stationary sleeve 12. In that event, the wafer is made to rotate in the cleaning and drying cycles, when the wafer is not engaged to the sleeve 12.

With either technique, the joining of the support 13 to the sleeve 12 forms the primary containment region 28. The wafer is located at the bottom to form the floor of this containment region 28. The processing fluid (electrolyte) is introduced into the containment region 28 through the shaft 16, as previously described. Electrical power is then applied to the anode and cathode electrodes to subject the wafer to an electroplating process to deposit material on the wafer. If desired, the wafer 35 can be washed and dried within the chamber 10 prior to the introduction of the electrolyte.

The cathode contact(s) to the wafer 35 is achieved by the cathode electrodes 15, as shown in FIG. 9. The multiple electrodes provide a distributed cathode, wherein the electrical contacts are made to the processing side of the wafer. This allows for the cathode potential to be applied to the processing face (front face) side of the wafer, instead of to the back side of the wafer. Again, it is appreciated that one or more than one cathode electrode(s) can be utilized. The preference is to have multiple electrodes 15.

During processing, new fluid is continually introduced into the primary containment region 28 to ensure a fresh supply of the processing chemical. As the level of the fluid rises, the overflow is discharged through the openings 30. In the instance that there are flow gaps 43 at the lower end of the sleeve 12, some amount of the medium also will drain from these openings. In any event, the cathodes are protected from the solution so that the plating process will not occur on them. When the purge manifold 20 is present, nitrogen gas is made to flow from it to prevent the electrolyte from contacting the backside of the wafer and the sidewall of the support 13.

When the process is completed, the electrical potential between the anode and the cathode is removed and the processing fluid flow stopped. Then, the wafer support 13 is positioned to its lower position to drain the electrolyte. Then, the DI water is introduced through the shaft channel 36. If sidewall openings 37 are present DI water is made to flow through these openings as well. DI water is also sprayed from the upper and lower manifolds 18 and 19 to wash the chamber 10. Subsequently, DI water is replaced by the flow of $N_2$ to dry the wafer 35 and the chamber 10. During the rinsing and drying cycles, the wafer 35 is usually spinning at a relatively high rpm (for example, in the range of 100–2000 rpm) to enhance the rinsing and drying of the wafer 35. Furthermore, the DI water and $N_2$ can be heated to an elevated temperature to enhance the rinsing and drying functions. Finally, the vacuum to the wafer is removed and the wafer removed through the access port 25.

Although a variety of metallic materials can be deposited by the technique of electroplating, the one metal which is suitable for the processing chamber of the present invention is copper. An example of copper electroplating is described in an article titled "Copper Electroplating Process For Sub-Half-Micron ULSI Structures;" by Robert J. Contolini et al.; VMIC Conference; Jun. 27–29, 1995; pp. 322 et seq.

Alternatively, the processing chamber of the present invention can also be utilized in the electropolishing of metallic materials. In that event, the processing steps described above are repeated, but with the use of chemicals which perform the metal removing function. Furthermore, the polarity of the potential applied to the electrodes are reversed so that the electrodes 15 now become a distributed anode and the single electrode 14 becomes the cathode electrode.

Again, although a variety of metallic materials can be polished by the technique of electropolishing, the one metal which is suitable for the processing chamber of the present invention is copper. An example of copper electropolishing is described in an article titled "A Copper Via Plug Process by Electrochemical Planarization;" by R. Contolini et al.; VMIC Conference; Jun. 8–9, 1993; pp. 470 et seq.

Additionally, an embodiment of the present invention allows for multiple processes to be performed in the processing chamber of the present invention. That is, more than one electroplating step or more than one electropolishing step can be performed. The multiple electroplating or electropolishing steps may entail the use of different chemistries. Additionally, it is to be noted that the same chamber 10 can be used to perform both electroplating and electropolishing. For example, in the first cycle, electrolyte for depositing a material is introduced and the wafer undergoes the electroplating process as described above. Then, instead of employing CMP to polish away the excess film, the electropolishing step described above is used. Subsequently, after rinsing and drying, a different electrolyte is introduced into the chamber and the wafer is electropolished. Thus, two separate processes, one electroplating and the other electropolishing, are performed in the chamber.

Accordingly, a number of advantages are derived from the use of the chamber 10 of the present invention. Since the primary containment region 28 is much smaller in volume than the secondary containment region 29, a substantially less chemical usage is needed to process a wafer. That is, the processing fluid is confined to a much smaller volume for processing the wafer. The secondary containment region 29 is used for drainage of the spent chemical and for providing secondary containment. This design allows the chamber 10 to be much larger in size, if needed, to house other components, such as metrology devices, but the fluid-fill area is maintained small. The processing fluid waste is reduced.

The vertical movement of the wafer support 13 allows wafer entry into the primary containment region 28, but at the same time shielding the underside of the wafer from the processing fluid when the wafer is being processed. The wafer is utilized to form the floor of the containment region. The alternative designs of the sleeve 12 allow it to be stationary or rotate (or oscillate) in unison with the wafer.

As to the electrodes, significant advantages are derived from the placement of the cathode electrodes 15. These electrodes 15 are located on the same side as the face of the wafer which is undergoing the particular process. Furthermore, the design of the chamber allows the cathode contacts to be isolated from the electrolyte, thereby preventing contaminants from the cathode contacts to be introduced into the chamber. The design also shields or isolates the wafer edge and the backside of the wafer from the electrolyte. Also, the wafer is positioned horizontally flat, so that gas bubbles formed during processing of the wafer by the electrolyte, tend to rise upward away from the wafer surface.

Additionally, the chamber design of the present invention permits multiple processing to be performed in the same chamber. The multiple processing within the chamber includes both electroplating and electropolishing. Thus, both deposition and material removable can be performed in the same chamber. Also, the rinsing and drying of both the containment regions 28 and 29 enhances the ability to keep the chamber clean of contaminants, which in turn eliminates the potential of processing chemicals from contaminating the fabrication clean-room through the ambient interface during wafer loading and unloading.

Figure 15:
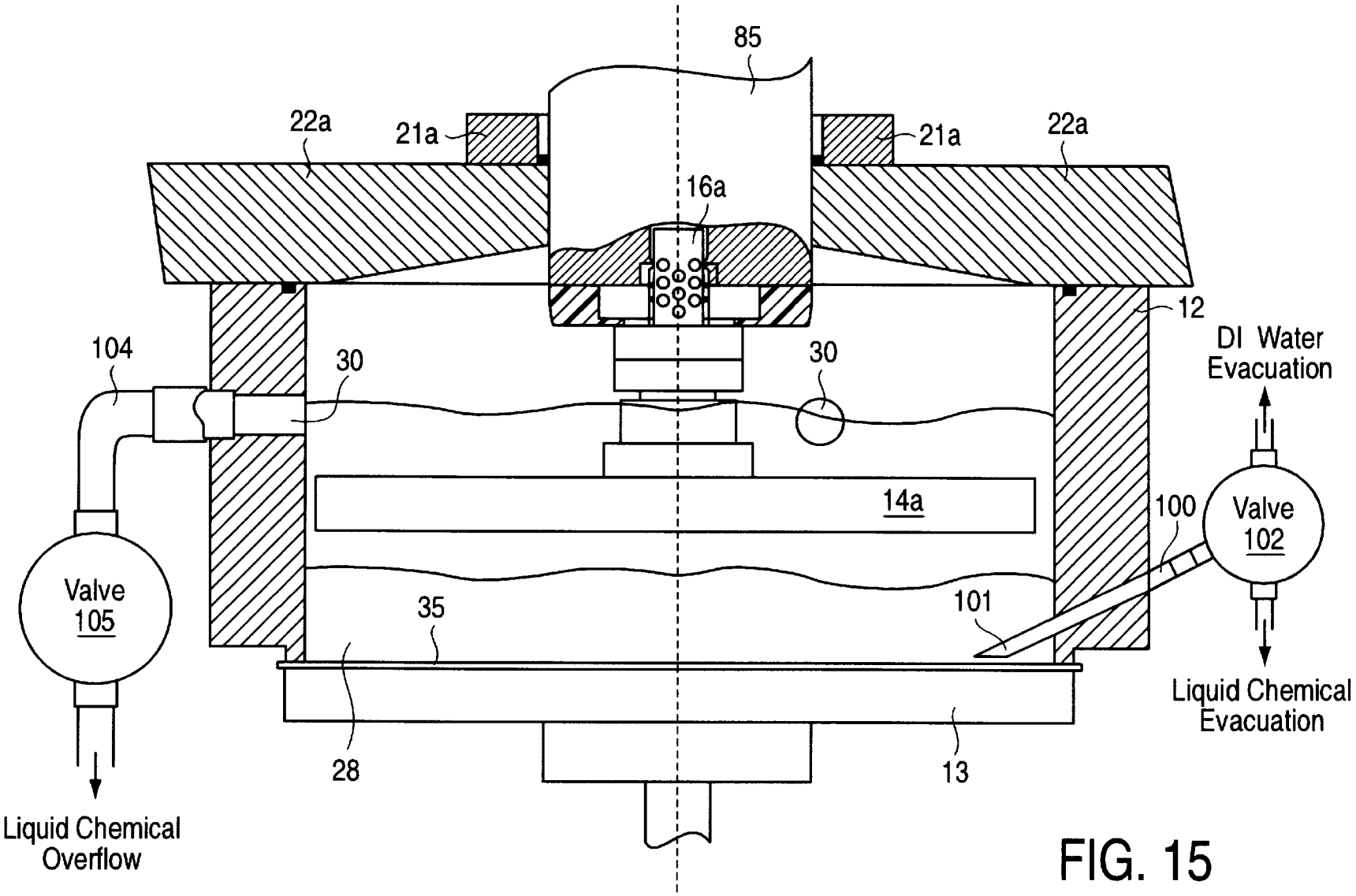
FIG. 15 is a cross-sectional view of an alternative design in which the sleeve is made stationary, allowing for fluid feed and/or evacuation openings to be disposed through the sleeve.

An alternative wafer processing technique is shown in FIG. 15. The configuration shown in FIG. 15 utilizes a stationary sleeve and a rotating (or oscillating) anode 14*a* for performing electroplating. Again, the anode would be configured as a cathode electrode, if the process to be performed is electropolishing. The wafer 35 residing on the support 13 is still raised to form the floor of the containment region (containment chamber) 28 for retaining the processing fluid (s). In this configuration, the support 13 and the sleeve 12 do not rotate when engaged together. The support can still rotate the wafer after disengaging from the sleeve. Instead of the stationary anode, the anode design described in reference to FIG. 14 is used, in which the anode 14*a* is made to rotate or oscillate. As noted previously, the fluid injection can be at the center or distributed along the lower surface of the anode 14*a*.

Since the sleeve is stationary, fluid connections can be made through the walls of the sleeve 12. In the illustrated example, a fluid evacuation outlet 100 is provided through the wall of the sleeve 12. In FIG. 15, an extension tube 101 is inserted through the outlet opening and made to reside just above the wafer 35. The tube 100 can be stationary or made to slide in the sleeve so that it can extend and retract from the containment region 28. The other end of the tubing 101 extends past the outer wall of the sleeve 12 and couples to a fluid valve 102. The proximity of the tube 101 near the surface of the wafer allows for the tube opening to be located close to the floor of the containment region 28 to ensure that most of the fluid can be captured.

Figure 16:
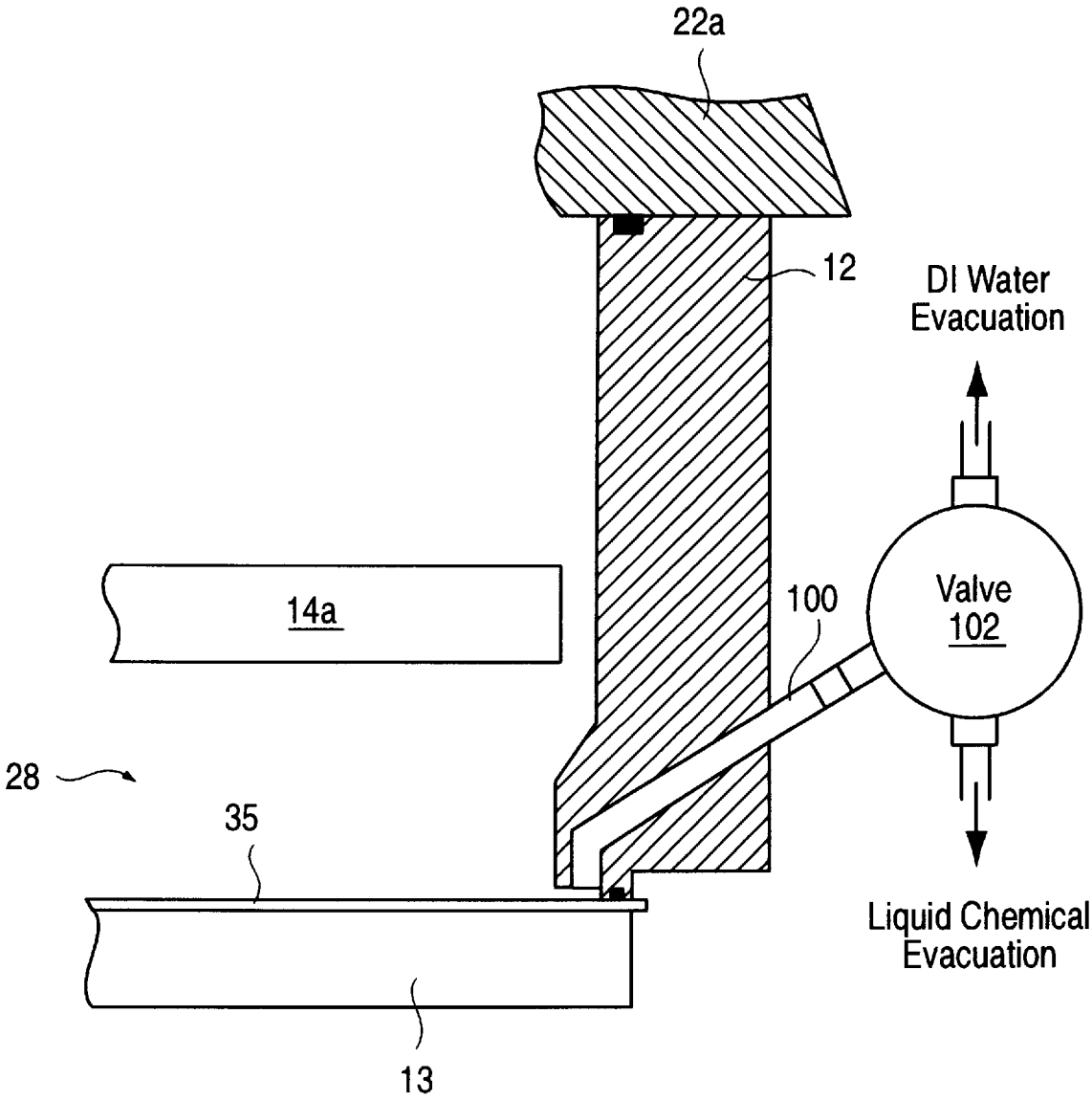
FIG. 16 illustrates an alternative fluid evacuation point for the sleeve configuration shown in FIG. 15.

An alternative location for the fluid pick up is shown in FIG. 16. In this embodiment, the evacuation opening does not penetrate the inner sidewall of the sleeve 12. Instead, the evacuation path is angled downward so that the point of evacuation is at the bottom of the sleeve 12 adjacent and in close proximity to the surface of the wafer 35. The wall thickness of the sleeve 12 is slightly enlarged at the bottom in the illustrated example to accommodate the evacuation opening.

Whether the design of FIG. 15, FIG. 16, or some other equivalent design is used, the purpose is to evacuate and capture the processing or cleaning fluid from the containment region 28. Generally, the fluid to be captured is in a liquid state, so that the evacuation outlet 100 is used for evacuating and capturing liquids. The capturing of liquids allows the liquids to be reused or recycled, which significantly reduces the supply and abatement/disposal requirements for processing chemicals. Capturing a particular liquid from the containment chamber 28, instead of at the drain 23, allows for less dilution of the liquids being recirculated. That is, in most liquid chemical recirculation systems, the amount of loss is typically attributed to chemical dilution, such as when mixing with water. Accordingly, the less amount of dilution occurring will result in a more efficient chemical recirculation.

The liquid evacuation system illustrated in FIGS. 15 or 16 permit processing chemicals to be captured while still within the closely confined containment region 28. The evacuation outlet 100 is coupled to a liquid pump for drawing out the electrolyte when the wafer processing is completed, but before the wafer is lowered. A valve 102 can be utilized to select a particular path for a chemical or chemicals. In the example illustration, valve 102 is shown directing liquid chemical in one path and d.i. water in another path (in the event d.i. water recirculation is desired). It is appreciated that the particular configuration of valves and pumps for recapturing the liquid(s) will depend on the types of fluid(s) utilized in processing the wafer and the types of fluid(s) which will be recirculated.

It is also appreciated that the outlet 100 and valve 102 can be utilized for injection of fluids into the chamber as well, or used in combination to inject and also to recapture the spent liquid. The injection of processing, rinsing and drying fluids through an opening through the sleeve, relieves the requirement of injecting fluids through the anode assembly. In this instance, the anode assembly can be constructed much simpler since fluid lines need not be disposed through the anode shaft 16. Alternative, different lines can be coupled to separately provide injection and evacuation of a fluid. In this instance, it is preferable to place the injection toward the upper part of the sleeve 12, while evacuation would still be provided at the lower end of the sleeve 12.

Also shown in FIG. 15 is an evacuation path 104 for the liquid overflow through openings 30. The path 104, which includes a valve 105, permits liquids flowing from the overflow openings to be captured and recirculated as well. It is appreciated that a variety of designs can be implemented to provide various introduction and/or evacuation of fluids from the containment region 28. However, the intent is to introduce the various fluids once the wafer 35 is seated properly to ensure a tight integrity with the sleeve and only disengaging the sleeve after the fluid in the containment region 28 has been evacuated. Furthermore, the configuration of FIG. 15, 16 can be readily implemented in single chambers with multiple processing or in multiple chambers of single or multiple processing, as described below.

Multiple Wafer Processing

Figure 12:
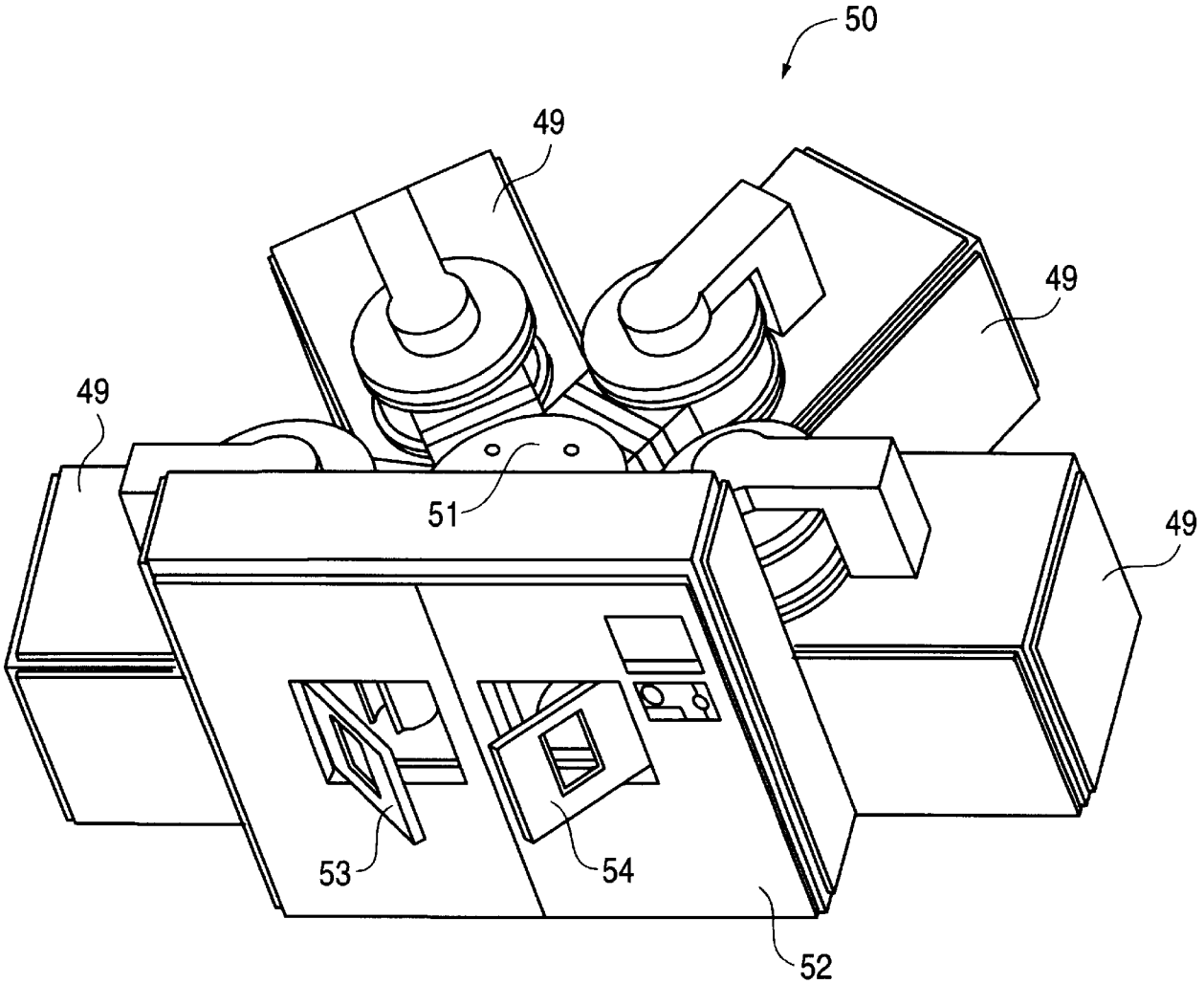
FIG. 12 is a pictorial illustration of a cluster tool in which multiple processing units shown in FIG. 11 are clustered together to operate as a system.

It is appreciated that the processing chamber 10 of the preferred embodiment can be configured into a system 50 to process more than one wafer at a time. In FIG. 12, a clustering of four separate processing chambers 10 is shown. The four chambers 10, each contained as a unit within the housing 49, are coupled to a central wafer handler mechanism 51, which is responsible for the movement of the wafer from one housing 49 to another. The central handler 51 is also coupled to an interface unit 52, which includes at least one access mechanism (two doors are shown in the drawing) for wafer entry/exit from the system.

As shown in FIG. 12, a wafer or a cassette of wafers is introduced into the system 50 through an entry door 53 located on the interface unit 52 (which unit is typically referred to as a load-station for loading and unloading the wafers). Once the wafer or cassette of wafers (hereinafter simply referred to as the wafer) enters door 53, it is isolated from the ambient environment until it exits through an exit door 54, also on the interface unit 52. It is appreciated that there are a variety of designs and techniques for moving the wafer through various stations. The particular description herein and the tool shown in FIG. 12 are for exemplary purpose. The coupling between the interface unit 52 and the handler 51, as well as between the handler 51 and each of the chambers 10, ensure that the wafer is isolated from the ambient environment. In some instances, this environment is filled with a non-active gas, such as nitrogen.

Once the wafer enters the interface unit 52, it is processed in one or more of the chambers 10. Each chamber 10 can provide the same processing step or the chambers 10 can be configured to provide different processing steps, or a combination thereof. For example, in implementing copper technology, the four chambers shown can all provide the same process or each can provide for different processes. Once completed, the handler 51 moves the wafer to the exit door 54 for removal from the system 50. The use of system 50 allows multiple wafers to be processed within a system.

Figure 13:
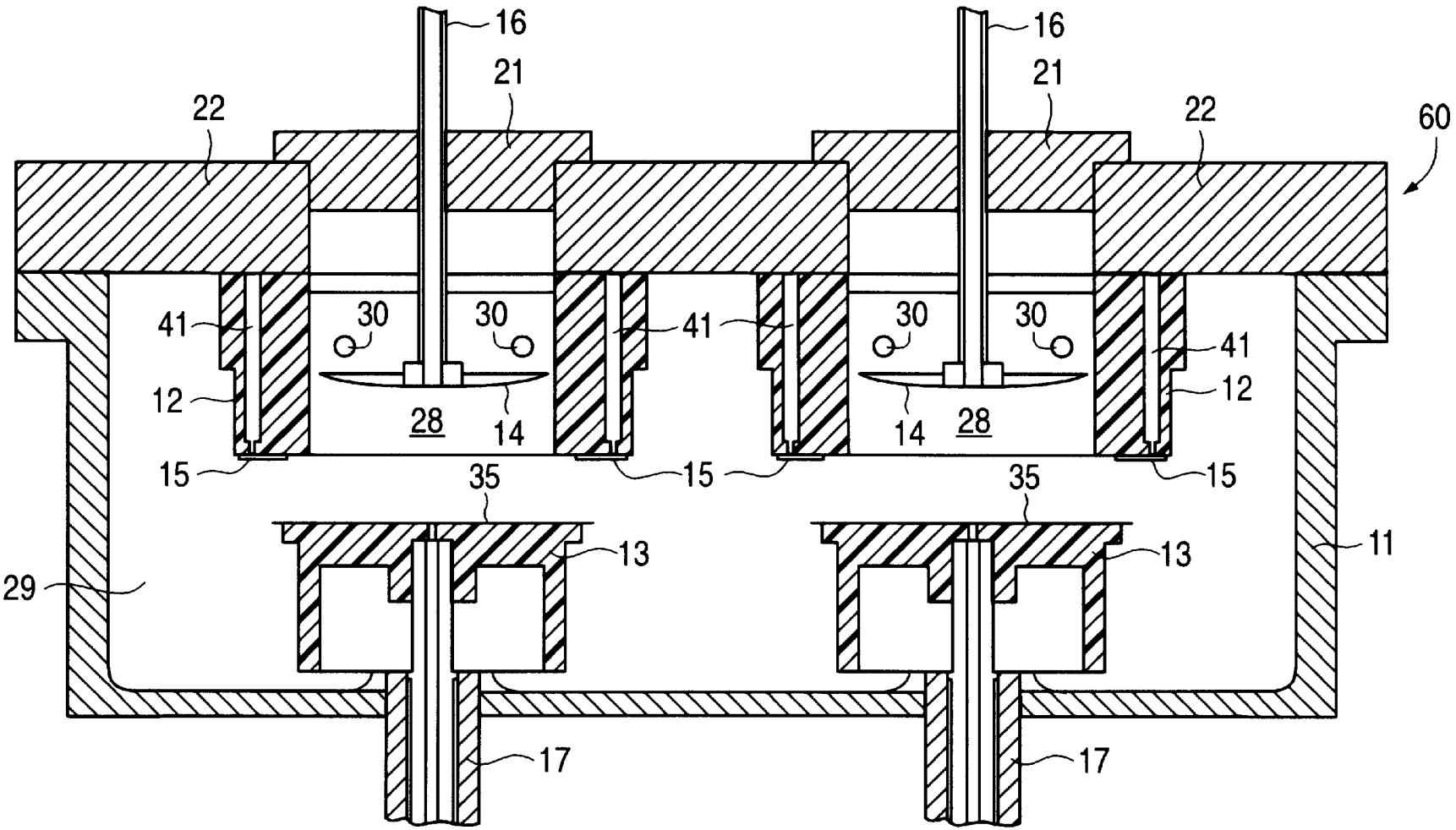
FIG. 13 is a cross-sectional view of an alternative embodiment of the present invention in which two sleeves configured together within one processing chamber for processing multiple wafers.

Referring to FIG. 13, it shows another approach in processing multiple wafers. In this instance multiple wafers are processed in the same processing chamber. A processing chamber 60 is equivalent to the processing chamber 10, except that now there are two separate primary containment regions 28 within the same casing. Separate sleeve 12, wafer support 13, anode 14 and set of cathodes 15 are still present for each wafer that will be processed. The cross-section of the floor of chamber 60 is shown flat in the illustration (not slanted as in chamber 10), but can be slanted as well. The electrolyte drain opening is also not shown, although present. Furthermore, the manifolds 18-20 are not shown in the Figure, but can be utilized as well. The access port is not shown as well, but generally is present, one each for each containment region 28.

A significant advantage of the multi-containment design of FIG. 13 resides in isolating each wafer within chamber 60. Each wafer will have its own primary containment region 28, subjected to its own electric field and processed by its own electrolyte. Thus, each wafer will have its processing performed and parameters adjusted, if necessary, independently from the other wafers. For example, power to one wafer can be disconnected, while still retained in the other. Although it is generally preferred to perform the same processing step for each of the wafers in chamber 60, the design could be adapted to perform different processes in each of the primary containment sleeves. Also, it is appreciated that only two containment units are shown in FIG. 13, but more containment units could be configured within chamber 60, if desired. Additionally, the stationary sleeve 12 design is shown in FIG. 13, but it is appreciated that the rotating sleeve design of FIG. 10 can be employed. The rotating anode can be utilized as well with the stationary sleeve.

Thus, a processing chamber for depositing material and/or removing material from a substrate, such as a semiconductor wafer, is described. The described techniques are generally applicable to metal and metal alloys, although the techniques can be readily adapted for non-metal processing. It is appreciated that there are a number of variations in implementing the chamber of the present invention. The various features described above can be included, depending on the design selected.

Furthermore, it is appreciated that the chamber can be constructed by the use of various materials known for constructing processing chambers in general. In the preferred embodiment, the casing is constructed from stainless steel, having an inner coating (such as TEFLON™) to prevent the chemical reaction on the inner wall of the casing. The wafer support and the manifolds are made from materials which do not react with the processing chemical. Polypropylene or other equivalent materials are acceptable. Quartz or ceramic is also another material which can be used for construction. The material for the sleeve should be an insulator as well, so that the sleeve does not act as or interact with the anode when power is applied. Accordingly, various materials can be readily configured for constructing the chamber of the present invention.

We claim:

1. An apparatus for processing a material residing therein by subjecting the material to a processing fluid, but in which the processing fluid is evacuated prior to removal of the material comprising:

a support for having the material reside thereon;

a hollow sleeve for forming a containment chamber to contain the processing fluid for processing the material, said sleeve having an open end wherein said support when raised to engage said sleeve, causes the material to enclose the open end of said sleeve to form an enclosing floor for the containment chamber to retain the processing fluid therein;

a first electrode coupled to reside within said hollow sleeve;

a second electrode adapted to contact a side of the material being processed, but being protected from the processing fluid during processing;

an outlet opening disposed on said sleeve for evacuation of the processing fluid from the containment chamber prior to lowering said support for removal of the material.

2. The apparatus of claim 1 further including an inlet opening disposed on said first electrode for injection of the processing fluid in to the containment chamber.

3. The apparatus of claim 2 wherein said outlet opening is located proximal to the bottom of the containment chamber.

4. The apparatus of claim 3 further including an overflow opening proximal to the upper portion of the containment chamber for recapture of the processing fluid if excess processing fluid is introduced into the containment chamber.

5. The apparatus of claim 3 further including an evacuation tube extending through said sleeve and outlet opening, wherein the processing fluid is evacuated from the containment chamber through said evacuation tube.

6. The apparatus of claim 3 wherein the containment chamber is utilized in which multiple processing fluids are utilized, in which a given processing fluid is evacuated from the containment chamber prior to the introduction of another processing fluid.

7. An apparatus for processing a semiconductor wafer residing therein by subjecting the semiconductor wafer to an electrolyte for electroplating or electropolishing the wafer, but in which the electrolyte is evacuated prior to removal of the wafer comprising:

a support for having the semiconductor wafer reside thereon;

a hollow sleeve for forming a containment chamber to contain the electrolyte for processing the semiconductor wafer, said sleeve having an open end wherein said support when raised to engage said sleeve, causes the wafer to enclose the open end of said sleeve to form an enclosing floor for the containment chamber to retain the electrolyte therein;

a first electrode coupled to reside within said hollow sleeve;

a second electrode adapted to contact a side of the wafer being processed, but being protected from the electrolyte during processing;

an outlet opening disposed on said sleeve for evacuation of the electrolyte from the containment chamber prior to lowering said support for removal of the semiconductor wafer.

8. The apparatus of claim 7 further including an inlet opening disposed on said first electrode for injection of the electrolyte in to the containment chamber.

9. The apparatus of claim 8 wherein said outlet opening is located proximal to the bottom of the containment chamber.

10. The apparatus of claim 9 further including an overflow opening proximal to the upper portion of the containment chamber for recapture of the electrolyte if excess electrolyte is introduced into the containment chamber.

11. The apparatus of claim 9 further including an evacuation tube extending through said sleeve and outlet opening, wherein the electrolyte is evacuated from the containment chamber through said evacuation tube.

12. The apparatus of claim 9 wherein the containment chamber is utilized in which multiple electrolytes are utilized, in which a given electrolyte is evacuated from the containment chamber prior to the introduction of another electrolyte.

13. An apparatus for processing a material residing therein by subjecting the material to a processing fluid and in which the processing fluid is introduced or evacuated comprising:

a support for having the material reside thereon;

a hollow sleeve for forming a containment chamber to contain the processing fluid for processing the material, said sleeve having an open end wherein said support when raised to engage said sleeve, causes the material to enclose the open end of said sleeve to form an enclosing floor for the containment chamber to retain the processing fluid therein;

a first electrode coupled to reside within said hollow sleeve;

a second electrode adapted to contact a side of the material being processed, but being protected from the processing fluid during processing;

an opening disposed on said sleeve for introduction of the processing fluid into the containment chamber after the material forms the enclosing floor or evacuation of the processing fluid from the containment chamber prior to lowering said support and releasing the enclosing floor.

14. A method of processing a substrate material residing in a containment chamber by subjecting the material to a processing fluid to electroplate or electropolish the material comprising:

placing the substrate material to be processed on a support;

providing a hollow sleeve to form the containment chamber to contain a processing fluid for processing the material, the sleeve having an open end in which the support is engaged to the sleeve such that the material forms an enclosing floor to retain the processing fluid therein, the sleeve also having an outlet opening present for evacuation of the processing fluid from the containment chamber;

providing a first electrode within the hollow sleeve;

providing a second electrode coupled to the material and contacting a side of the material being processed, but being protected from the processing fluid;

raising the support to engage the material to the sleeve to enclose the bottom of the containment chamber;

filling the containment chamber with the processing fluid;

applying a potential across the first and second electrodes to process the material performing the electroplating or electropolishing to process the material evacuating the containment chamber of the processing fluid through the outlet opening prior to disengaging the enclosing floor;

lowering the support to disengage the material from the sleeve which also removes the enclosing floor from the containment chamber.

15. The method of claim 14 wherein said providing the first electrode includes providing a first electrode which has an inlet opening disposed thereon for injection of the processing fluid in to the containment chamber.

16. The method of claim 15 wherein said providing the sleeve includes providing a sleeve having the outlet opening located proximal to the bottom of the containment chamber.

17. The method of claim 16 wherein said providing the sleeve includes providing an overflow opening proximal to the upper portion of the containment chamber for level control to recapture the processing fluid if excess processing fluid is introduced into the containment chamber.

18. The method of claim 16 wherein said providing the sleeve includes providing an evacuation tube extending through the sleeve and outlet opening to evacuate the processing fluid.

19. The method of claim 18 wherein the providing of the evacuation tube places an end of the evacuation tube proximal to the material.

* * * * *